US008997876B2

(12) United States Patent
McHugh et al.

(10) Patent No.: US 8,997,876 B2
(45) **Date of Patent: *Apr. 7, 2015**

(54) RETRIEVABLE FLOW MODULE UNIT

(71) Applicant: Cameron International Corporation, Houston, TX (US)

(72) Inventors: Edmund McHugh, Longford (IE); Finbarr Evans, Ballynacargy (IE); Tobias Voelkel, Hannover (DE)

(73) Assignee: Cameron International Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/045,093

(22) Filed: Oct. 3, 2013

(65) Prior Publication Data

US 2014/0027125 A1 Jan. 30, 2014

Related U.S. Application Data

(63) Continuation of application No. 13/421,254, filed on Mar. 15, 2012, now Pat. No. 8,550,170, which is a continuation of application No. PCT/EP2012/000595, filed on Feb. 9, 2012.

(51) Int. Cl.

| | |
|---|---|
| ***E21B 33/037*** | (2006.01) |
| ***E21B 34/02*** | (2006.01) |
| ***E21B 34/04*** | (2006.01) |

(52) U.S. Cl.

CPC ..... *E21B 34/02* (2013.01); *E21B 33/037* (2013.01); *E21B 34/045* (2013.01)

(58) Field of Classification Search

CPC ..... E21B 33/037; E21B 34/04; E21B 34/045

USPC ..... 166/351, 338, 341, 343, 344, 360, 368, 166/250.01; 137/315.02

See application file for complete search history.

(56) References Cited

U.S. PATENT DOCUMENTS

| | | | |
|---|---|---|---|
| 4,046,192 | A | 9/1977 | Darnborough et al. |
| 4,075,862 | A | 2/1978 | Ames |

(Continued)

FOREIGN PATENT DOCUMENTS

| | | |
|---|---|---|
| EP | 2180136 | 4/2010 |
| GB | 2319795 | 6/1998 |

(Continued)

OTHER PUBLICATIONS

Strømmen, PCT International Search Report and Written Opinion for PCT/EP2012/000595, Oct. 11, 2012.

*Primary Examiner* — Matthew Buck
(74) *Attorney, Agent, or Firm* — Eubanks PLLC

(57) ABSTRACT

A retrievable flow module (RFM) apparatus is provided. In one embodiment, the RFM apparatus is a standalone assembly configured to mate with a subsea device, such as a production tree. The RFM apparatus may include a frame within which various flow control and monitoring elements are disposed. The frame may have an alignment system that enables the RFM apparatus to horizontally mate with the tree. Because the RFM apparatus provides for the collocation of flow control and monitoring elements within a standalone assembly, deployment or retrieval of the flow control and monitoring elements may be accomplished in single operation. Additional systems, devices, and methods are also disclosed.

17 Claims, 29 Drawing Sheets

(56) References Cited

U.S. PATENT DOCUMENTS

| | | | | |
|---|---|---|---|---|
| 4,191,256 | A | 3/1980 | Croy et al. | |
| 4,382,717 | A | 5/1983 | Morrill | |
| 4,625,805 | A | 12/1986 | Ladecky | |
| 5,255,745 | A | 10/1993 | Czyrek | |
| 5,730,551 | A | 3/1998 | Skeels et al. | |
| 6,068,427 | A | 5/2000 | Østergaard | |
| 6,481,504 | B1 | 11/2002 | Gatherar | |
| 6,805,382 | B2 | 10/2004 | Jennings | |
| 6,907,932 | B2 | 6/2005 | Reimert | |
| 6,938,695 | B2 | 9/2005 | Williams | |
| 6,997,645 | B2 | 2/2006 | von Trepka et al. | |
| 7,331,396 | B2 * | 2/2008 | Reimert et al. | 166/368 |
| 8,550,170 | B2 | 10/2013 | McHugh et al. | |

FOREIGN PATENT DOCUMENTS

| | | |
|---|---|---|
| GB | 2357100 | 6/2001 |
| GB | 2448230 | 10/2008 |

* cited by examiner

RETRIEVABLE FLOW MODULE UNIT

CROSS-REFERENCE TO RELATED APPLICATIONS

This application is a continuation of U.S. Patent Application No. 13/421,254 filed on Mar. 15, 2012, which is a continuation of PCT International Patent Application No. PCT/EP2012/000595, entitled "Retrievable Flow Module Unit", filed on Feb. 9, 2012, which is herein incorporated by reference in its entirety.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted.

In the case of an offshore system, such a wellhead assembly may include one or more subsea components that control drilling and/or extraction operations. For instance, such components may include one or more production trees (often referred to as "Christmas trees"), control modules, a blowout preventer system, and various casing, valves, fluid conduits, and the like, that generally facilitate the extraction of resources from a well for transport to the surface. As can be appreciated, production trees often include certain elements for flow monitoring and control that may be more prone to failure than other types of components. For instance, such elements may generally be more sensitive to harsh subsea environmental conditions. Accordingly, these elements may require maintenance and repair during the life of a resource extraction system. Additionally, it may also be desirable to replace such components with updated corresponding components from time to time, such as with those having improved or new features.

In certain conventional resource extraction systems, these components may be distributed at different locations on the tree. Accordingly, retrieval of these components from a subsea location, whether for maintenance or replacement, may be challenging and costly.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure relate generally to a retrievable flow module (RFM) unit in which flow control and monitoring elements of a subsea system may be collocated. The RFM unit may be a standalone assembly having a horizontal deployment configuration such that the RFM unit is configured to horizontally mate with a subsea device, such as a production tree. In one embodiment, the RFM unit may include an alignment system that is hydraulically actuated, either by on-board hydraulics or by way of a hydraulic tool that is removably installed during the mating process and removed from the RFM unit thereafter. Because the RFM unit provides for the collocation of various flow control and monitoring elements, as well as certain ancillary elements (e.g., sensors and chemical injection devices) into a standalone assembly, retrieval of these elements for repair, maintenance, or replacement may be greatly facilitated when compared to certain conventional subsea systems in which such elements are distributed at different locations.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
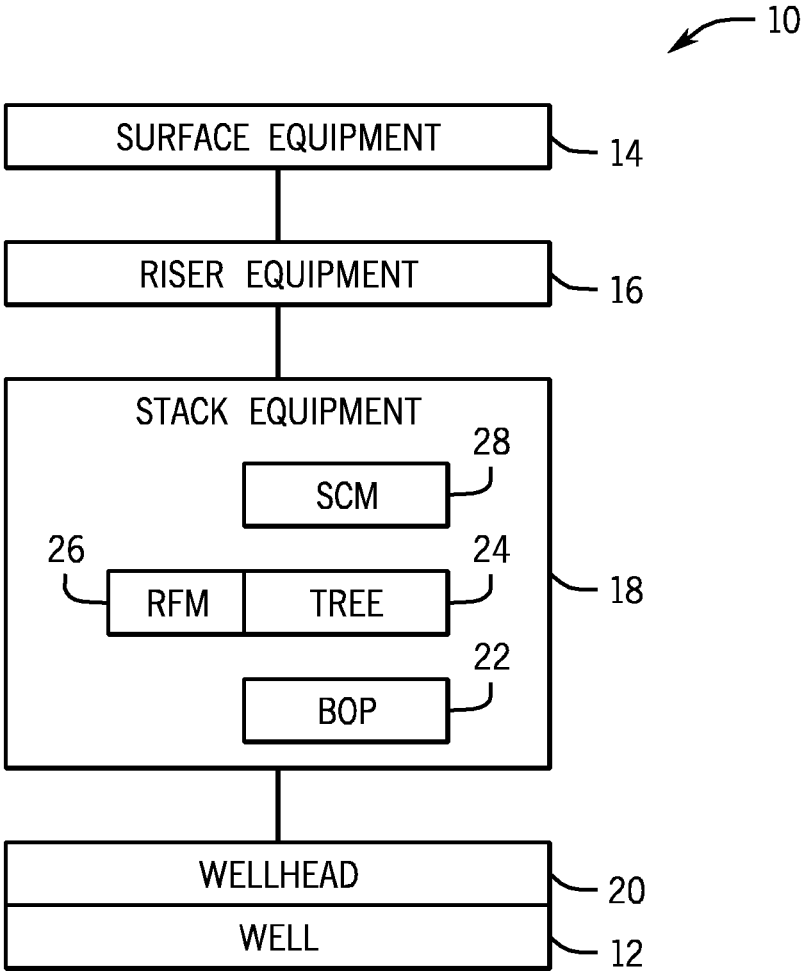
FIG. 1 depicts a subsea resource extraction system that includes a production tree in accordance aspects of the present disclosure.

Referring initially to FIG. 1, an exemplary resource extraction system 10 is illustrated in accordance with an embodiment of the present invention. The system 10 is configured to facilitate the extraction of a resource, such as oil or natural gas, from a well 12. As shown, the system 10 includes a variety of equipment, such as surface equipment 14, riser equipment 16, and stack equipment 18, for extracting the resource from the well 12 by way of a wellhead 20. The system 10 may be used in a variety of drilling or extraction applications. Further, while the system 10 is depicted as an offshore or "subsea" system, it will be appreciated that onshore systems are also available. In the depicted system 10, the surface equipment 14 is mounted to a drilling rig located above the surface of the water, whereas the stack equipment 18 is coupled to the wellhead 20 proximate the sea floor. The surface equipment 14 and stack equipment 18 may be coupled to one another by way of the riser equipment 16.

As can be appreciated, the surface equipment 14 may include a variety of devices and systems, such as pumps, power supplies, cable and hose reels, control units, a diverter, a gimbal, a spider, and the like. Similarly, the riser equipment 16 may also include a variety of components, such as riser joints, fill valves, control units, and a pressure-temperature transducer, to name but a few. The riser equipment 16 may facilitate transmission of extracted resources (e.g., oil and/or gas) to the surface equipment 14 from the stack equipment 18 and the well 12.

The stack equipment 18 may include a number of components, including a blowout preventer (BOP) 22. The blowout preventer 22 may include one or more ram-type and/or annular blowout preventers. In some embodiments, the stack 18 may include multiple blowout preventers 22 of the same type for redundancy purposes. The blowout preventer 22 may function during operation of the resource extraction system 10 to regulate and/or monitor wellbore pressure to help control the volume of fluid being extracted from the well 12 via the wellhead 20. For instance, if well pressures are detected as exceeding a safe threshold level during drilling or resource extraction, which may indicate a possible or imminent blowout, the blowout preventer 22 may seal off the wellhead 20, thus capping the well 12. By way of example, in an embodiment where the blowout preventer 22 includes a ram-type blowout preventer, a pair of opposing rams may extend toward the center of a wellbore. Such rams may be fitted with packers that form an elastomeric seal, which may seal the wellhead 20 and effectively cap the well 12.

Other components of the stack equipment 18 may include a production tree 24, also commonly referred to as a "Christmas tree," a retrievable flow module unit 26 and a subsea control module (SCM) 28. The tree 24 may include an arrangement of valves, and other components that control the flow of an extracted resource out of the well 12 and upward to the riser equipment 16 which in turn facilitates the transmission of the extracted resource upward to the surface equipment 14, as discussed above. In some embodiments, the tree 24 may also provide additional functions, including chemical injection functionality and pressure relief.

As further shown in FIG. 1, the tree 24 may be configured to interface with a retrievable unit that may include flow monitoring and control elements, referred to herein as the retrievable flow module (RFM) unit 26. As discussed in more detail below, the RFM unit 26 may provide a compact standalone package in which several control and monitoring components are located and arranged in a single retrievable module. Because these control and monitoring components, which may be referred to as "smart components" and may represent the primary failure items for the tree 24, are generally disposed in a single location at the RFM unit 26, retrieval of such components for repair and/or replacement is facilitated. That is, there is no need to retrieve the complete tree 24 or to separately retrieve the smart components in different retrieval operations. The subsea control module 28 may provide for electronic and hydraulic control of the various components of the stack equipment 18.

Before continuing, it should be understood that while referenced as a separate element, the RFM unit 26 may be considered as part of the tree 24 in the sense that the RFM unit 26 may include components that the tree 24 uses for proper operation. Further, the subsea control module 28 may also be mounted on the tree 24 in some embodiments. Moreover, in an embodiment where the stack equipment 18 includes multiple trees 24, the RFM unit 26 may instead be coupled to a common manifold to which each tree 24 is fluidly connected, or to a subsea processing station. Further, as will be discussed in more detail below, the RFM unit 26 has a horizontal deployment configuration, which enables the RFM unit 26 to horizontally mate with a tree 24 or other subsea device. Such a horizontal deployment configuration, when compared to certain conventional subsea equipment that uses vertical deployment configurations, may substantially reduce pipe bends in some instances. This reduction in pipe bends may allow for the RFM unit 26 to have a smaller form factor and reduced erosion "hot-spots" (areas sensitive or more prone to erosion). This will be illustrated in more detail below with reference to FIGS. 37 and 38.

Figure 2:
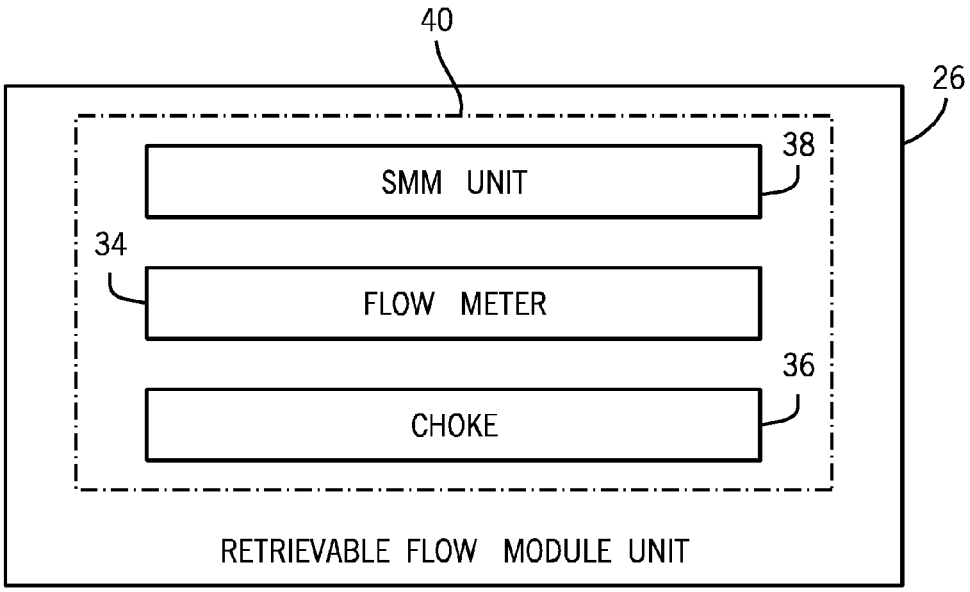
FIG. 2 is a block diagram showing a retrievable flow module (RFM) unit having a horizontal deployment configuration for interfacing with the production tree of FIG. 1.

With these points in mind, FIG. 2 is a simplified block diagram that may represent the RFM unit 26 in accordance with one embodiment of the present invention. As shown, the RFM unit 26 may include a flow meter 34, a choke 36, and a subsea monitoring module (SMM) unit 38. The flow meter 34 may include a multiphase flow meter for measuring characteristics of individual phase flow rates during resource extraction. For example, in some embodiments, a multiphase flow meter 34 may measure flow rates of oil, water, and gas mixtures extracted from the well 12. In other embodiments, the flow meter 34 may also include a wet gas flow meter configured to measure flow rates of constituents of a wet gas flow. The choke 36 of the RFM unit 26 may be fluidly coupled to the flow meter 34 and may be configured to allow for control of the flow rate of resources extracted from the well 12.

The SMM unit 38 may include a controller configured to provide control and monitoring functions. Though not explicitly shown in FIG. 2, the RFM unit 26 may include various sensors configured to sense and relay various operating parameters to the SMM unit 38. In some embodiments, multiple controllers may be provided for redundancy purposes. The SMM unit 38 may receive various input signals from flow devices (e.g., flow meter 34) and the above-mentioned sensors of the RFM unit 26, which may include pressure and temperature transducers, sand detection sensors, corrosion and erosion sensors, and so forth. Additionally, the SMM unit 38 may also provide for control (e.g., feedback-based control) of chemical injection metering valves (CIMV) at one or more chemical injection points for introduction of chemicals that may help to prevent production issues, such as blockages and corrosion.

As will be appreciated, the various components of RFM unit 26 may generally be disposed within a frame, depicted in FIG. 2 as reference number 40. Particularly, as will be discussed in more detail below, the frame may include an alignment system that facilitates alignment of the RFM unit 26 to the tree 24 during an interfacing process in which the RFM 26 is securely and horizontally mated to the tree 24 in a fluidly coupled manner. Accordingly, the use of the RFM unit 26 described in the present disclosure may provide several advantages when compared to conventional Christmas tree designs. For instance, because the RFM unit 26 is configured as a standalone assembly, factory acceptance testing (FAT) is facilitated. Additionally, due to this standalone configuration, monitoring and flow controlling components of the tree 24 may be retrieved in a single retrieval operation, such as for repair and/or replacement purposes. For instance, when compared to certain conventional designs, this standalone RFM configuration makes it relatively easy for an operator to change or update monitoring and flow control elements of the RFM unit 26 or, in some instances, to replace the whole RFM unit 26 itself during the lifecycle of the resource extraction system 10 without affecting the primary configuration of the tree 24.

Having provided a general overview of the RFM unit 26, a more detailed description of various embodiments of the RFM unit 26 is provided below. Specifically, FIGS. 3 to 13 generally depict a first embodiment of the RFM unit 26, FIGS. 15 to 17 generally depict a second embodiment of the RFM unit 26, FIGS. 18 to 21 generally depict a third embodiment of the RFM unit 26, and FIGS. 22 to 32 generally depict a fourth embodiment of the RFM unit 26. These embodiments and variations thereof are described in detail below. For the purpose of differentiation, different reference numbers have been given to the each of these embodiments of the RFM unit 26. However, it should be understood that the RFM unit 26 depicted in FIGS. 1 and 2 may represent any of the embodiments described below.

Figure 3:
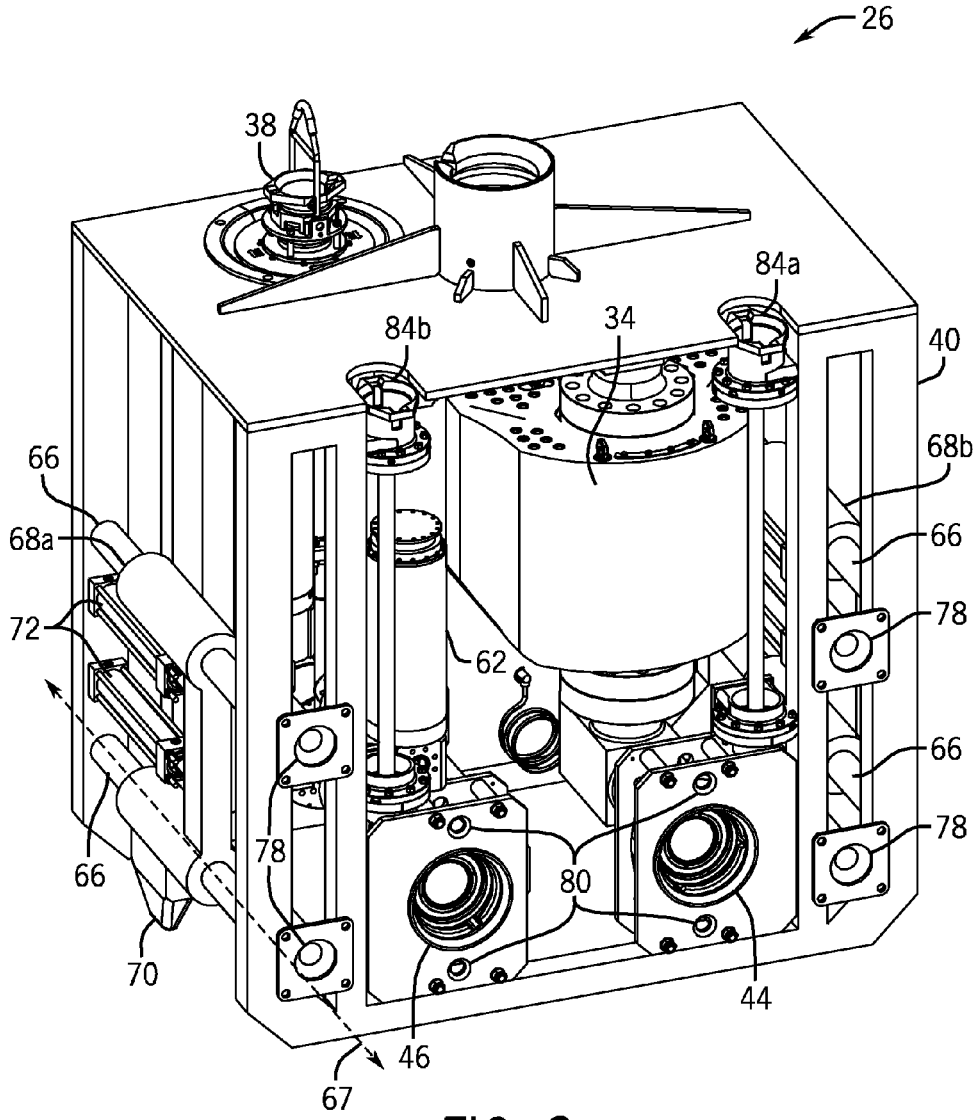
FIGS. 3 to 6 provide several views showing a first embodiment of the RFM unit.
Figure 4:
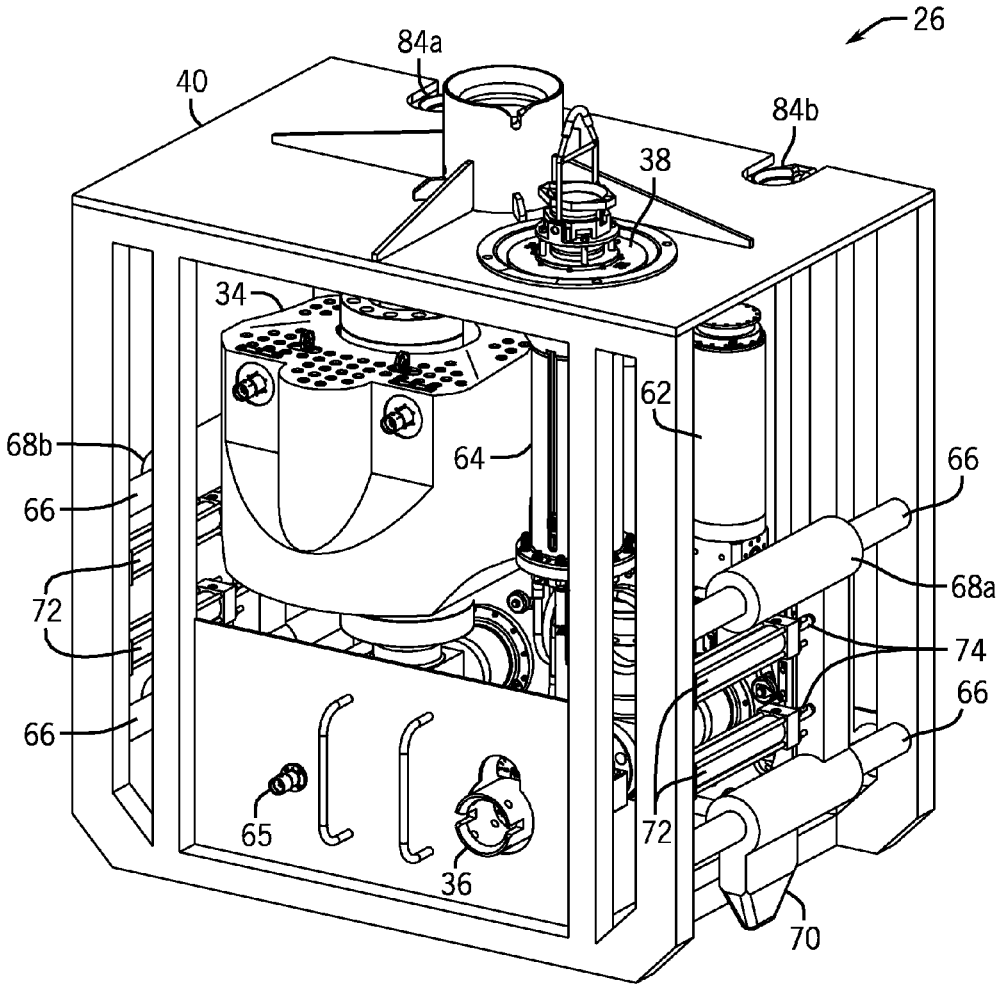
Figure 6:
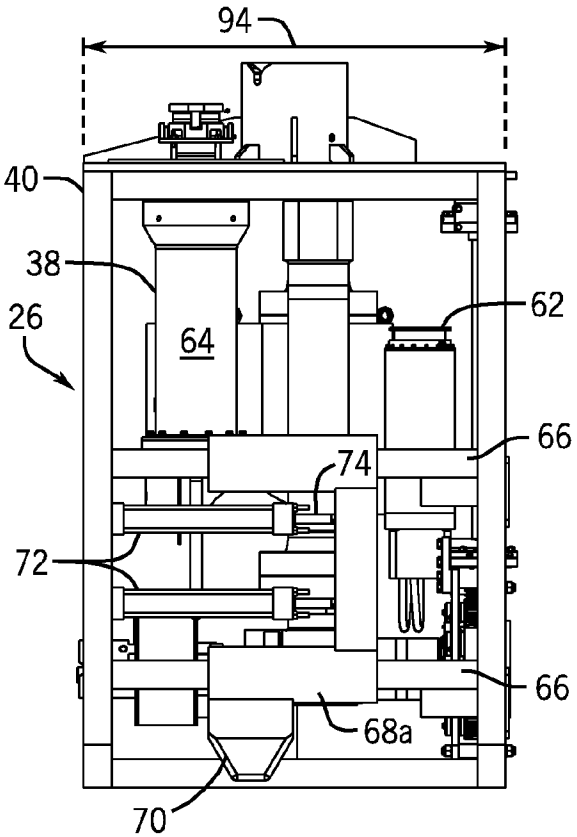
Figure 5:
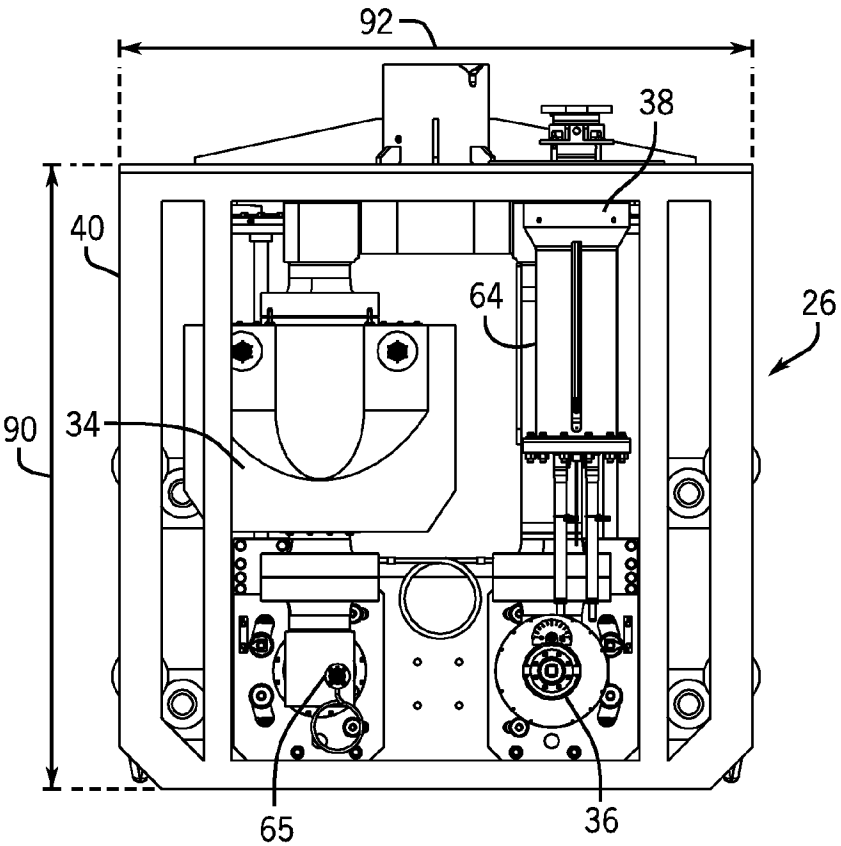

Referring first to FIGS. 3 to 6, these figures depict various views of the RFM unit 26 in accordance with a first embodiment of the present invention. Specifically, FIG. 3 shows a frontal perspective view of the RFM unit 26, FIG. 4 shows a rear perspective view of the RFM unit 26, FIG. 5 shows a rear view of the RFM unit 26, while FIG. 6 shows a side view of the RFM unit 26. As used herein, the "front" or "frontal side" of the RFM unit 26 or the like shall be understood to refer to the face of the RFM unit 26 that directly mates to the tree 24, whereas the "back," "rear," or the like of the RFM unit shall be understood to refer to the face of the RFM unit 26 that faces outwardly from the tree 24 when the RFM unit 26 is interfaced with the tree 24. Moreover, the terms "side," "top," and "bottom," as used to identify the remaining faces of the RFM unit 26, shall be understood to refer to the corresponding sides, top, and bottom faces of the RFM unit 26 based on its orientation when mated to the tree 24.

Concurrent reference is made to FIGS. 3 to 6 in the description of the first embodiment herein. For instance, as best shown in FIG. 3, the RFM unit 26 includes an inlet 44 by which extracted resources may enter the RFM unit 26 and an outlet 46 through which the extracted resources exit the RFM unit 26. When the RFM unit 26 is mated to the tree 24, the inlet 44 may be fluidly coupled to a first valve of the tree 24 through which extracted materials from the well 12 flow, often referred to as a wing valve, and the outlet 46 may be fluidly coupled to a flow line that may direct the extracted material upward to the riser equipment 16 and surface equipment 14. As discussed above, the RFM unit 26 has a horizontal deployment configuration that reduces pipe bends in the RFM unit 26 and tree 24, thus enabling the RFM unit 26 to have a smaller form factor relative to those with vertical deployment configurations and to exhibit reduced erosion-prone areas, which may be particularly beneficial downstream of the choke 36 (e.g., flow velocities downstream of a choke may be accelerated as fluid is accelerated in choke trims).

Figure 7:
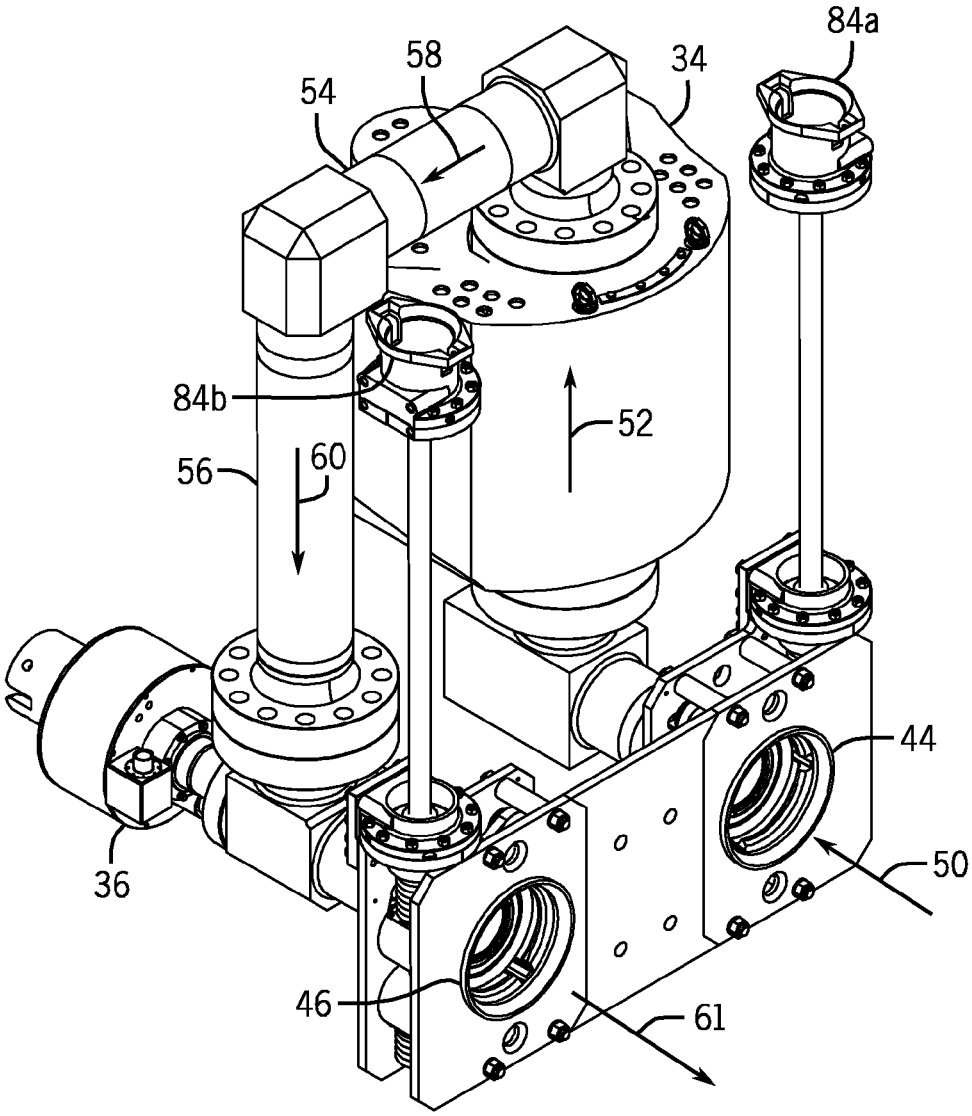
FIG. 7 depicts the arrangement of a flow meter and choke in the first embodiment of the RFM unit, as shown in FIGS. 3 to 6.

Referring briefly to FIG. 7, the flow meter 34 and choke 36 are shown removed from the frame 40 to more clearly illustrate the flow path of extracted resources through the RFM unit 26. It is noted that the flow meter 34 is disposed upstream of the choke 36 relative to the direction of fluid flow in this first embodiment, although the flow meter 34 may also be disposed downstream of the choke 36 in other embodiments, as will be described further below. As shown by arrow 50 in FIG. 7, fluid including resources extracted from the well 12 may enter the RFM unit 26 from the wing valve block of the tree 24 via the inlet 44. The fluid may then flow through the flow meter 34, as indicated by arrow 52. As discussed above, the flow meter 34 may be a multiphase flow meter that is configured to measure characteristics of individual phases within the fluid, which may include water, oil, and gas phases, or may be a wet gas flow meter. Thereafter, the fluid may continue through conduits 54 and 56, as indicated by arrows 58 and 60, respectively, to the choke 36, which may be configured to provide for control of the flow rate of the fluid. The choke may 36 may be a mechanically controlled choke (e.g., hydraulic) in some embodiments, or may be an electrically controlled choke in other embodiments. The fluid may then exit the RFM unit 26 by way of the outlet 46, as indicated by arrow 61 and continue through a flow line toward the surface equipment 14 of the resource extraction system 10.

Referring again to FIGS. 3 to 6, the RFM unit 26 of the first embodiment is shown as including a chemical injection metering valve 62. As discussed above, the chemical injection metering valve 62 may be configured to provide for the injection of chemicals in subsea applications. For instance, certain chemicals, such as low-dose hydrate inhibitors, may be introduced into the flow of the extracted resources from the well 12 at one or more chemical injection points that may be beneficial in helping to prevent blockages, which may improve production output and extend the life of the resource extraction system 10. By way of example only, in one embodiment, the chemical injection metering valve 62 may be of a model manufactured by Cameron International Corporation of Houston, Texas. Further, while the embodiment of the RFM unit 26 shown in FIGS. 3 to 6 includes only a single chemical injection metering valve 62, it should be understood that other embodiments may employ multiple chemical injection metering valves 62 while further embodiments of the RFM unit 26 may omit the chemical injection metering valve altogether, which may allow for a reduction in the size of the RFM unit 26. In the latter case, chemical injection metering valves may be located on the tree 24 rather than the RFM unit 26.

As further shown in the embodiment of FIGS. 3 to 6, the SMM unit 38 of the RFM unit 26 may be enclosed within a generally cylindrical canister 64. As best shown in FIGS. 4 and 5, the rear face of the RFM unit 26 includes a communication port 65 which may allow for the RFM unit 26 to be communicatively connected to the subsea control module 28 (FIG. 1) and/or a communication distribution unit, for example, by way of a suitably configured electrical cable harness. By way of example, the connection of such a cable harness between the communication port 65 of the RFM unit 26 and corresponding port(s) on the subsea control module 28 may be achieved using a remotely operated vehicle (ROV).

Further, in some embodiments, the SMM unit 38 may be configured such that it may be retrieved independently of the RFM unit 26, such as by using the aforementioned ROV. For instance, an ROV may retrieve the canister 64 from the RFM 26 and bring it to the surface. Thus, overall, the standalone RFM unit 26 with a separately retrievable SMM unit 38 may provide a flexible design. For example, an RFM unit may be supplied for a particular tree 24 and may be later replaced with an updated RFM unit. Further, since the SMM unit 38 is independently retrievable and may accommodate multiple communication configurations and sensor interfaces, the SMM unit 38 may also be updated relatively easily during the life of the resource extraction system 10 without having to replace the entire tree 24 or RFM unit 26.

As discussed above, the frame 40 of the RFM unit 26 may include an alignment system that facilitates the alignment of the RFM unit 26 to the tree 24 during an interfacing process in which the RFM 26 is mated to the tree 24 in a fluidly coupled manner. In the embodiment shown in FIGS. 3 to 6, the alignment system may include a pair of sliding members 68*a* and 68*b* located on opposing side faces of the RFM unit 26. The sliding members 68*a* and 68*b* include respective alignment members 70, shown here as teeth-like structures, for engaging a corresponding slot on the tree 24 and may be configured to slide in a horizontal direction 67 along rods 66 that extend across the frame 40 (across the side faces of the RFM unit 26) during the alignment and interfacing process. In some embodiments, the sliding mechanism may also be located along a mid-vertical point (e.g., at a point between the top face and bottom face of the RFM unit 26 within the area enclosed by the frame 40) or at a top location (e.g., along the top face of the RFM unit 26). Due to the higher center of gravity in such embodiments, it may be easier to actuate the sliding member(s) 68 to translate the RFM unit 26 in the horizontal direction.

The alignment system additionally includes hydraulic cylinders 72. As best shown in FIGS. 3, 4, and 6, each hydraulic cylinder 72 may include a first end coupled to the frame 40 and a second end having a corresponding piston rod 74 (best shown in FIGS. 4 and 6) coupled to a sliding member 68. During the alignment and interfacing process, the piston rods 74 may be retracted into the hydraulic cylinders 72 to facilitate alignment. The RFM unit 26 additionally includes a first set of alignment slots 78 and a second set of alignment slots 80 (best shown in FIG. 3) that may be configured to mate with corresponding guide pins on the tree 24 during alignment. As shown in FIGS. 3 to 6, the RFM unit 26 further includes torque clamps 84*a* and 84*b* that may be configured to secure the inlet 44 to a wing valve line of the tree 24 and the outlet 44 to a flow line of the tree 24, respectively. The alignment and interfacing process will be described in more detail below with reference to FIGS. 8 to 13.

When taking into perspective the general dimensions of subsea equipment, the RFM unit 26 may provide the various flow monitoring and control elements described above into a standalone unit having a relatively small footprint. For instance, referring to FIGS. 5 and 6, the illustrated embodiment of the RFM unit 26 may have a height 90 and width 92 each being between approximately 80 to 100 inches (excluding the slight protrusion of certain components from the top face of the RFM unit 26), and a depth 94 of between approximately 50 to 70 inches, thus providing for a volume of between approximately 320,000 cubic inches (approximately 185 cubic feet) and 700,000 cubic inches (approximately 405 cubic feet). In one particular embodiment the RFM unit 26 may have a height 90 of approximately 89 inches, a width 92 of approximately 90 inches, and a depth 94 of approximately 60 inches, resulting in a volume of 480,600 cubic inches (approximately 278 cubic feet). Additionally, the standalone configuration of the RFM unit 26 also facilitates the deployment and retrieval of such components, i.e., the components may be brought to the surface for maintenance, repair, and/or replacement in a single retrieval operation.

The above-referenced process for aligning and interfacing the embodiment of the RFM unit 26 shown in FIGS. 3 to 6, which may be collectively referred to herein as a mating process, will now be described in greater detail with reference to FIGS. 8 to 13. In particular, the mating process includes a multi-stage alignment process, wherein each successive stage of the alignment process is progressively finer relative to a previous alignment stage, and an interfacing step in which the aligned RFM unit 26 is secured to the tree 24.

Figure 8:
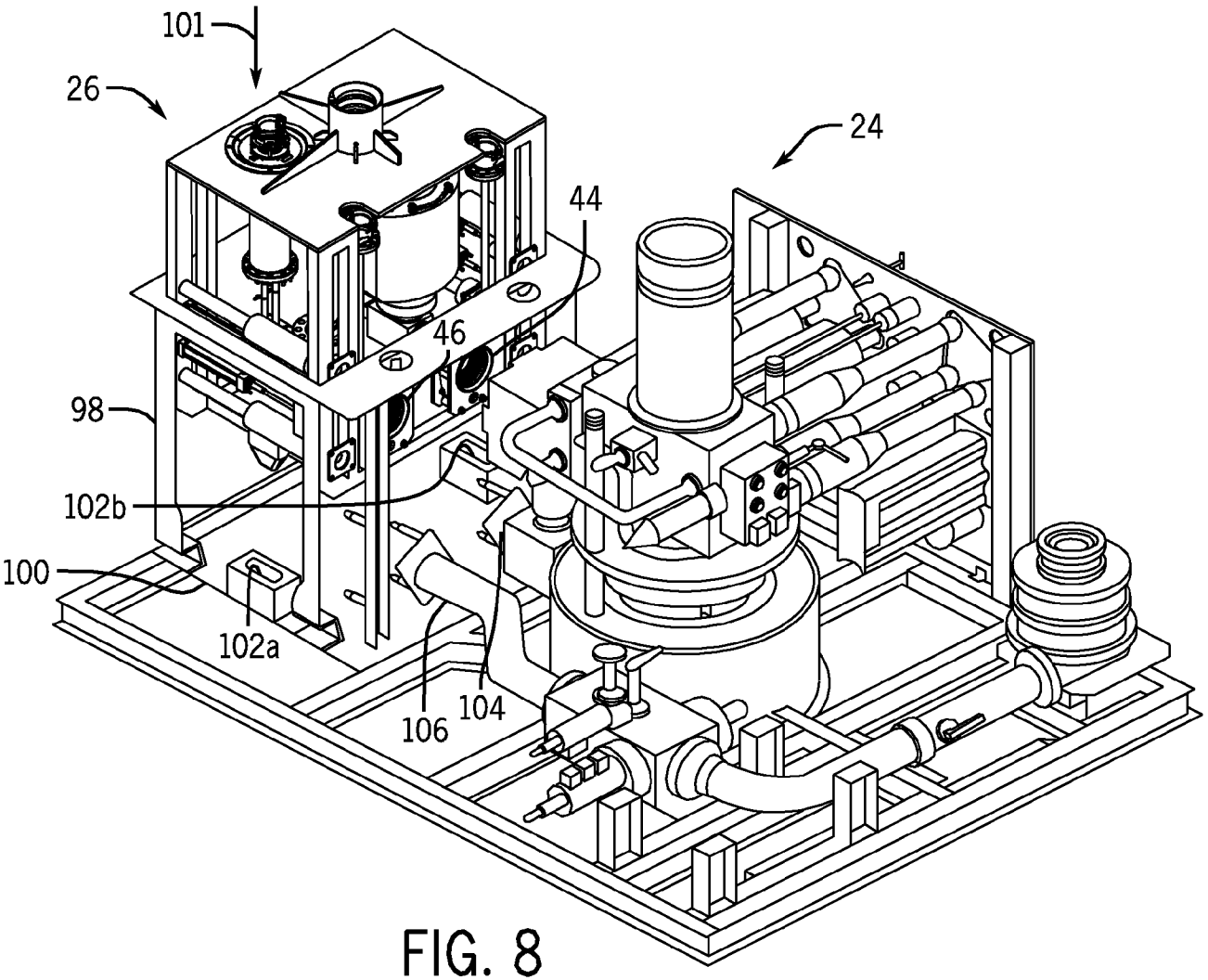
FIGS. 8 to 13 illustrate various steps for carrying out a multi-stage alignment and interfacing process that mates the RFM unit of FIGS. 3 to 6 to the subsea production tree using an alignment system having one or more sliding members and hydraulic cylinders in accordance with an embodiment of the present invention.

Referring first to FIG. 8, a first stage of the multi-stage alignment process is illustrated in which the RFM unit 26 is lowered into a guide frame 98 extending from a docking platform 100 of the tree 24, as indicated by the direction of arrow 101. That is, the guide frame 98 provides a first "crude" alignment step for positioning the RFM unit 26 for interfacing with the tree 24. As can be appreciated, the RFM unit 26 may be deployed from the surface to the subsea location of the tree 24 using any suitable technique, such as by way of ROV, running tool, or wireline deployment. Within the area of the platform 100 generally enclosed by the guide frame 98, protruding structures defining first and second slots 102*a* and 102*b* are provided. As will be described below in FIGS. 9 and 10, the slots 102*a* and 102*b* may receive the alignment teeth 70 corresponding to sliding members 68*a* and 68*b*, respectively, of the RFM unit 26. FIG. 8 additionally illustrates the wing valve line 104 and the flow line 106 to which the inlet 44 and outlet 46, respectively, of the RFM unit 26 will be fluidly connected at the completion of the alignment and interfacing process.

Figure 9:
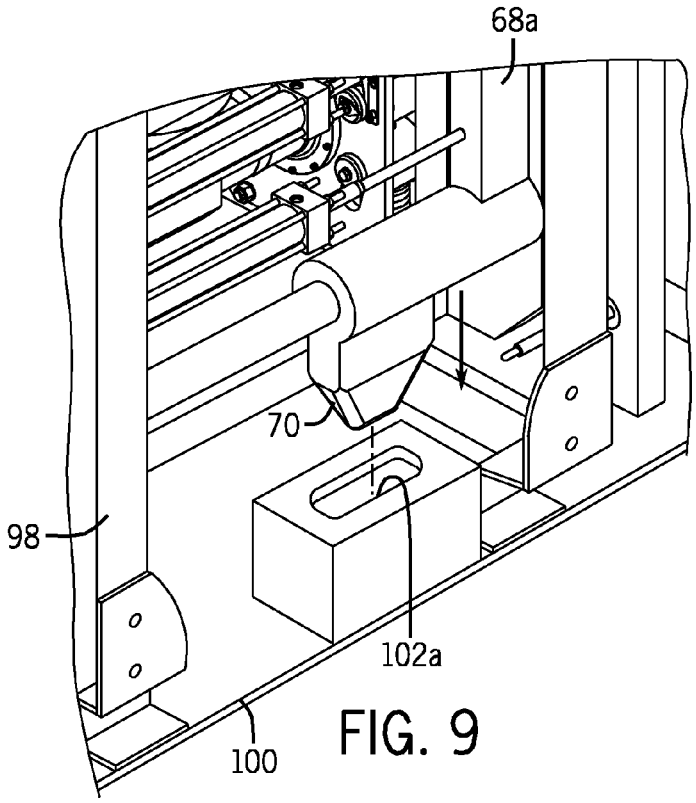
Figure 10:
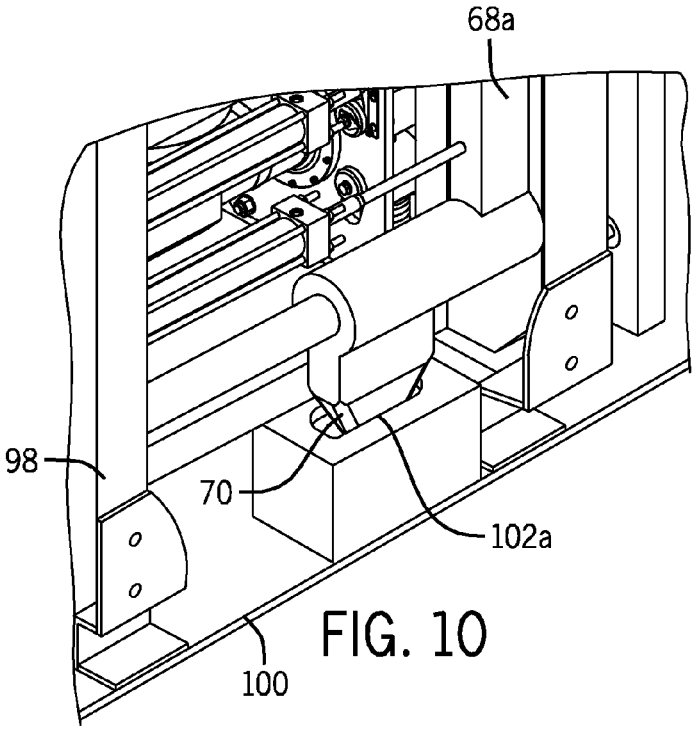

FIGS. 9 and 10 collectively depict in greater detail how the alignment tooth 70 of the sliding member 68*a* (on a first side face of the RFM unit 26) is received by the slot 102*a* as the RFM unit 26 is fully lowered into the guide frame 98, thus providing for a second stage of alignment that provides for finer alignment relative to the first stage. Though not explicitly depicted, it should be understood that as the alignment tooth 70 of sliding member 68*a* engages the slot 102*a*, the alignment tooth 70 of the sliding member 68*b* on the opposite side face of the RFM unit 26 also engages the slot 102*b* substantially concurrently. Further, it should be noted that in some embodiments, the tree 24 may not include a guide frame 98 and, instead, the engagement of the alignment teeth 70 with the slots 102 may constitute an initial alignment stage.

While the alignment members 70 are shown as teeth-like structures in FIGS. 9 and 10, other types of alignment structures may also be used. For example, in some embodiments, the alignment members 70 may be pin-like structures (e.g., similar to guide pins 110 or 112) that engage corresponding slots 102 on the platform 100. In another embodiment, the alignment members 70 on the RFM unit 26 may be receptacle or slot-like structures that receive pins or teeth-like structures extending upwardly from the platform 100. Further, in some embodiments, instead of using the alignment structures 70 and 102, the RFM unit 26 may be mated to the tree 24 by way of a corner feature or porch located on the tree 24. In such embodiments, an ROV may push the RFM unit 26 into position as it is lowered via wireline deployment.

Figure 12:
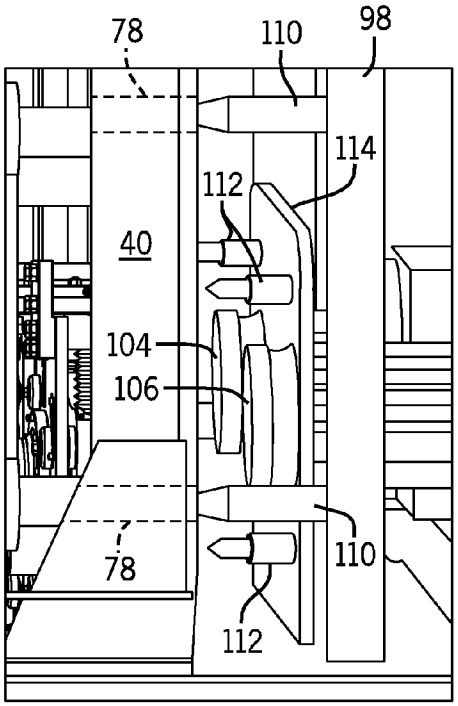
Figure 11:
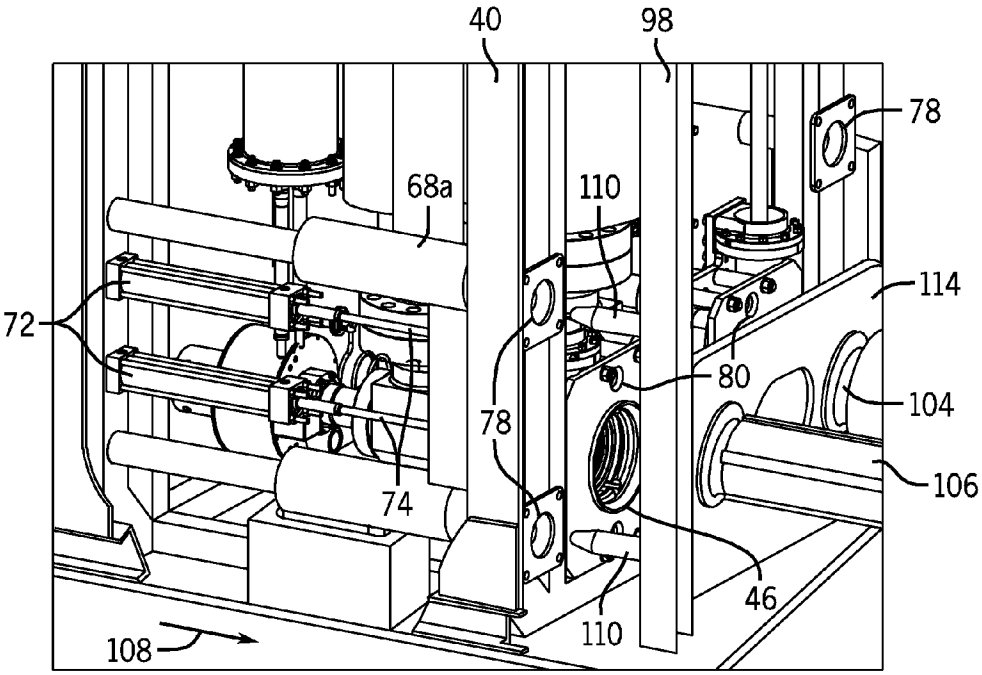

The third and fourth stages of the multi-stage alignment process are subsequently performed, as depicted in FIGS. 11 and 12. For instance, following the completion of the second alignment step, the hydraulic cylinders 72 are actuated to cause each piston rod 74 to retract into its respective cylinder 72. Because the sliding members 68*a* and 68*b* are generally held in a stationary position relative to the tree 24 due to their respective teeth 70 being engaged by the slots 102*a* and 102*b*, the retraction of the piston rods 74 will cause the hydraulic cylinders 72 to move in a direction toward the tree 24 (indicated by arrow 108). This results in the front face of the RFM unit 26 being moved gradually toward the tree 24 as the piston rods 74 are retracted, since the retraction of the piston rods 74 will cause the sliding members 68*a* and 68*b* to slide away from the front face of the RFM unit 26 along the rods 66 relative to the position of the frame 40.

As shown in FIGS. 11 and 12, the guide frame 98 includes a first set of guide pins 110 extending toward the front face of the RFM unit 26. A second set of guide pins 112 also extends toward the front face of the RFM unit 26 from a plate 114 supporting the ends of the wing valve line 104 and flow line 106 that are configured to horizontally mate with the inlet 44 and outlet 46, respectively, of the RFM unit 26. In the illustrated embodiment, the first set of guide pins 110, which may be longer and/or larger than the second set of guide pins 112, is configured to engage the corresponding set of alignment slots 78 on the frame 40 as the RFM unit 26 is translated in the horizontal plane toward the tree 24 in response to the retraction of the piston rods 74 into their respective hydraulic cylinders 72.

Figure 13:
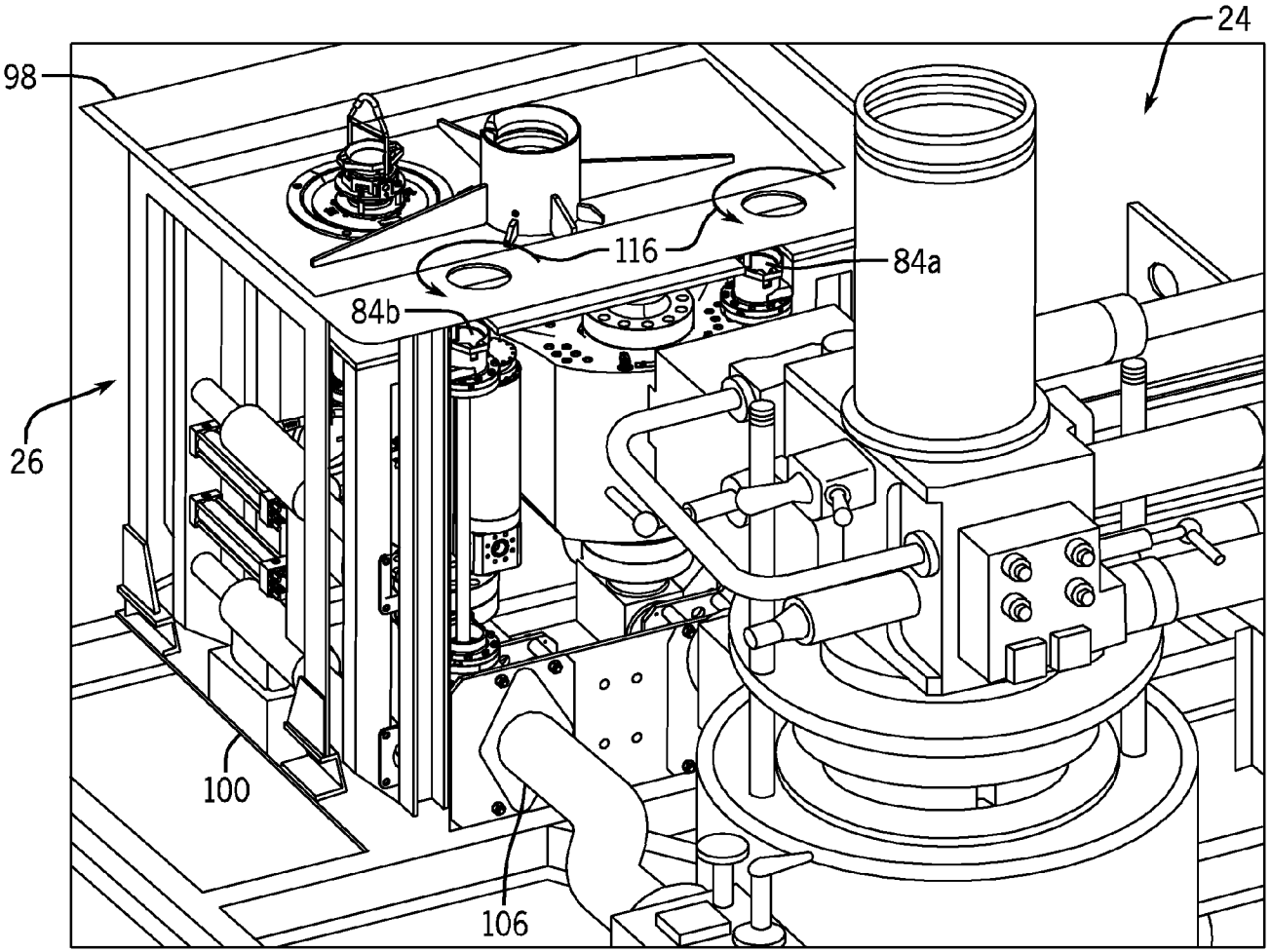

Finally, the second set of smaller guide pins 112 also engages the corresponding set of alignment slots 80 as the RFM unit 26 continues to move toward the tree 24. Thus, as the alignment slots 78 receive the guide pins 110 and the alignment slots 80 receive the guide pins 112, increasingly finer third and fourth stages of alignment, respectively, are provided. The retraction of the piston rods 74 into their respective cylinders 72 may continue until the guide pins 110 and 112 are substantially inserted into the respective sets of alignment slots 78 and 80. At this point, the RFM unit 26 may be fully aligned with the tree 24, as shown in FIG. 13.

In this fully aligned position, a portion of the wing valve line 104 and a portion of the flow line 106 may extend into the inlet 44 and outlet 46, respectively. The interfacing of the aligned RFM unit 26 to the tree 24 is further accomplished by actuating the torque clamps 84*a* and 84*b*, thus securing the wing valve line 104 to the inlet 44 and the flow line 106 to the outlet 46 and completing the mating process. By way of example, the torque clamps 84 may be single bore clamps that are actuated using a torque tool on an ROV to rotate the clamps 84 in the direction indicated by arrows 116. While two torque clamps 84*a* and 84*b* are shown FIG. 13, other embodiments may include a single clamp hub having a dual bore integral.

Once aligned and fully interfaced with the tree 24, a cable harness may be routed between the RFM unit 26 and the subsea control module 28, which may be mounted to the tree 24 in some embodiments. For instance, the cable harness may be connected to the communication port 65 of the RFM unit 26 and a corresponding communication port on the subsea control module 28, thus allowing for exchange of data between these components. For example, as shown in the embodiment of FIGS. 3 to 6, the SMM unit 38 of the RFM unit 26 may be enclosed within a generally cylindrical canister 64. As best shown in FIGS. 4 and 5, the rear face of the RFM unit 26 includes a communication port 65 which may allow for the SMM unit 38 of the RFM unit 26 to be communicatively connected to the subsea control module 28 (FIG. 1) and/or a communication distribution unit by way of a suitably configured electrical cable harness. By way of example, the connection of such a cable harness between the communication port 65 of the RFM unit 26 and corresponding port(s) on the subsea control module 28 may be achieved using a remotely operated vehicle (ROV) or by any other suitable method. Further, in some embodiments, the SMM unit 38 may be retrieved independently of the RFM unit 26, such as by using the aforementioned ROV.

Figure 14:
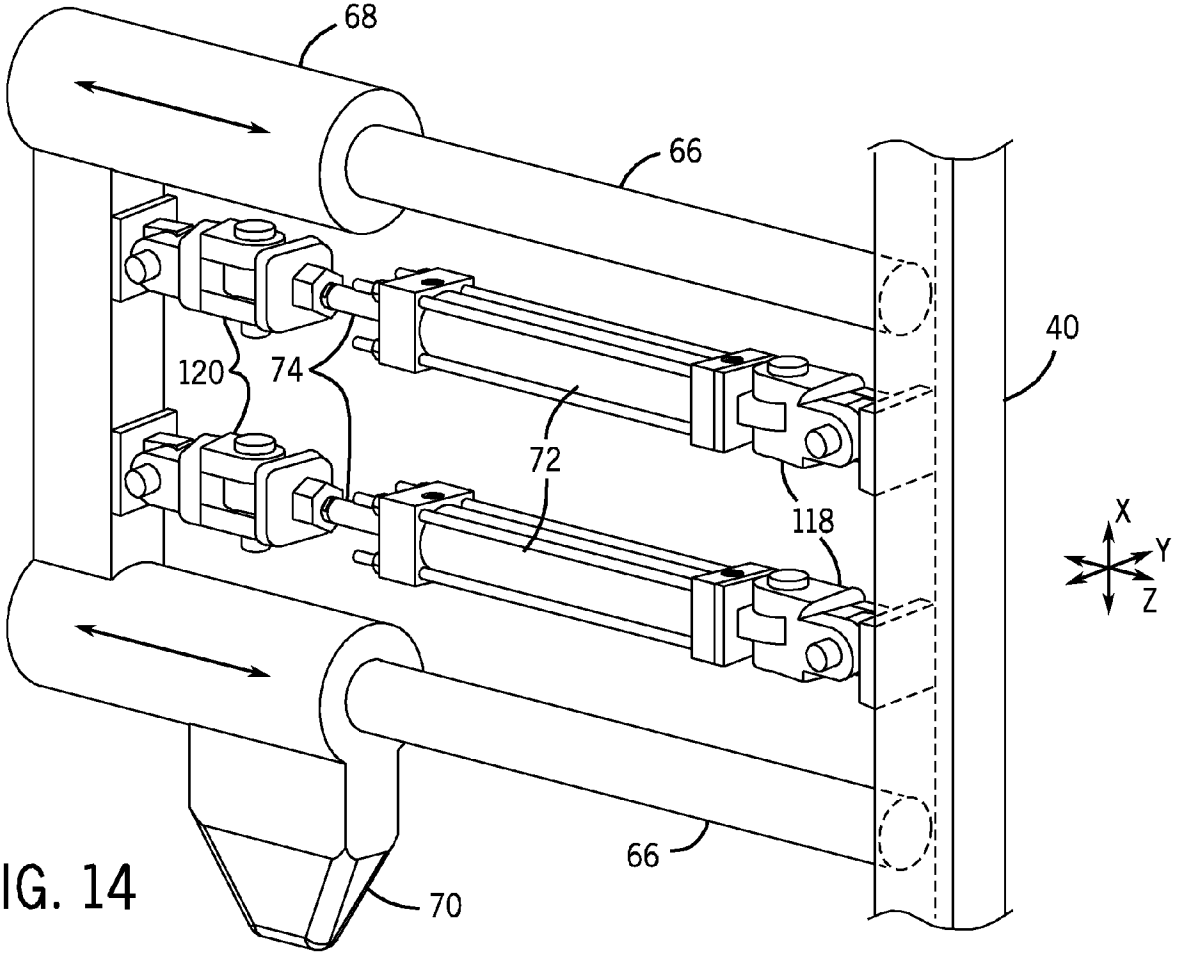
FIG. 14 shows another configuration of a sliding member and a hydraulic cylinder that includes one or more knuckle joints to further enhance the alignment process illustrated in FIGS. 8 to 13 in accordance with an embodiment of the present invention.

FIG. 14 shows another embodiment of the alignment system of the RFM unit 26 discussed above. Particularly, the embodiment shown in FIG. 14 includes knuckle joints 118 and 120 that may provide for enhanced alignment of the RFM unit 26 with the tree 24 during the mating process described above. For instance, for each hydraulic cylinder 72, a first intervening knuckle joint 118 is provided between a first end of the hydraulic cylinder 72 and the frame 40 of the RFM unit 26 while a second intervening knuckle joint 120 is provided between the distal end of the piston rod 74 and the sliding member 68. As can be appreciated, the use of the knuckle joints 118 and 120 may allow for a degree of movement in generally the x- and y-directions (as indicated by the axes shown in FIG. 14), which may help to correct for misalignments during the above-described alignment process.

As will be appreciated, the multi-stage actuated horizontal sliding deployment of the RFM unit 26 allows for a controlled "soft" make-up of the flow line connections and any hydraulic and/or electrical connections that may be present as the RFM unit 26 mates with the tree 24 (or other subsea device). This may reduce the possibility of damage to such connection points. In another embodiment, instead of the actuated sliding mechanism described above, the RFM unit 26 may instead include one or more threaded bars integral to the RFM unit 26. In this embodiment, horizontal translation of the RFM unit 26 is achieved via rotation of the threaded bar(s). The rotation may be achieved, for instance, using an ROV or by a suitably configured motor located on the RFM unit 26. Still, in further embodiments, the RFM unit 26 may not utilize hydraulic cylinders 72 at all. Instead, a separate device, such as a running tool, may be utilized to facilitate movement of the RFM unit 26 toward the tree 24 during the mating process. Such an embodiment will be described in more detail below with reference to FIGS. 22 to 32.

Figure 15:
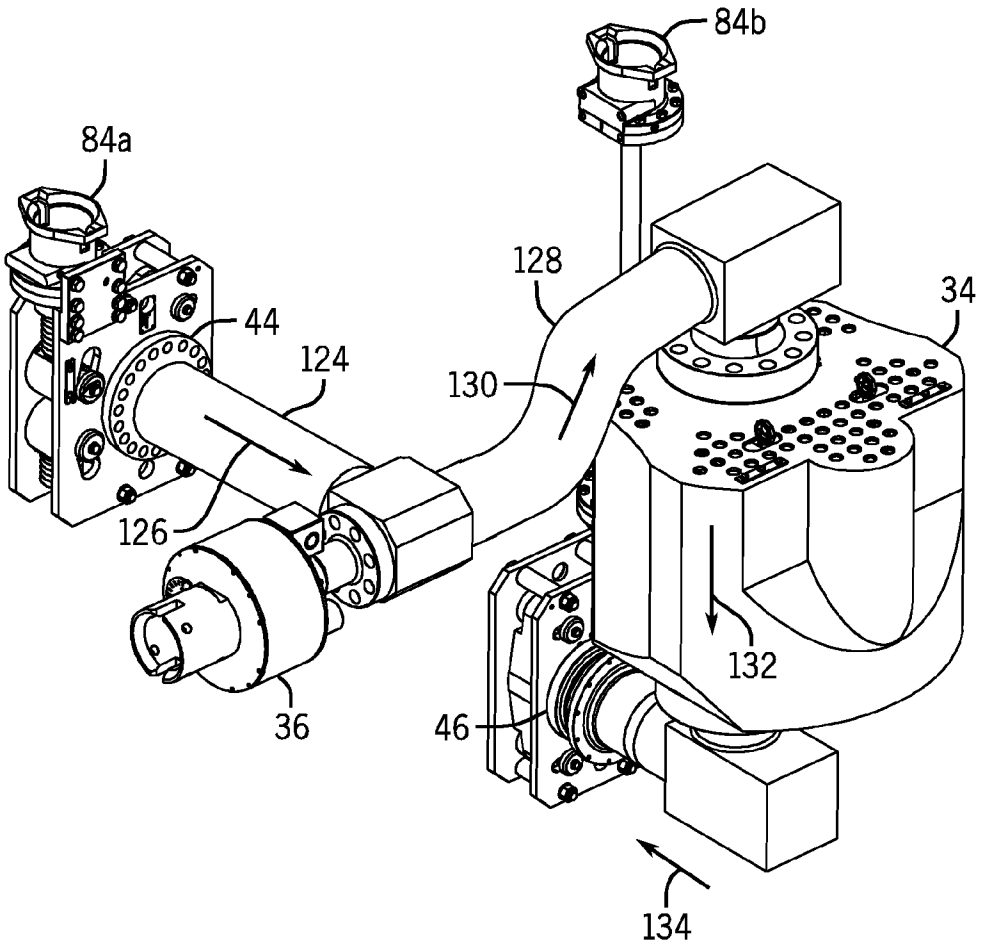
FIGS. 15 to 17 provide several views showing a second embodiment of the RFM unit.

As discussed above, in certain embodiments, the configuration of the flow meter 34 and choke 36 may be reversed with respect to the configuration shown above in FIG. 7. That is, the choke 36 may be positioned upstream from the flow meter 34 with respect to the direction of fluid flow through the RFM unit 26. Referring to FIG. 15, which shows such a configuration, the choke 36 is located upstream from the flow meter 34 with respect to the direction of fluid flow (arrow 126) into the inlet 44. Here, material extracted from the well 12 enters the inlet 44 from the wing valve of the tree 24 and flows through conduit 124, as indicated by arrow 126, to the choke 36. Thereafter, the fluid may continue through conduit 128 and continue through the flow meter 34, as indicated by arrows 130 and 132, respectively. The fluid may then exit the RFM unit (referred to by reference number 140 in FIG. 16) by way of the outlet 46, as indicated by arrow 134 and may continue through a flow line toward the surface equipment 14 of the resource extraction system 10.

Figure 16:
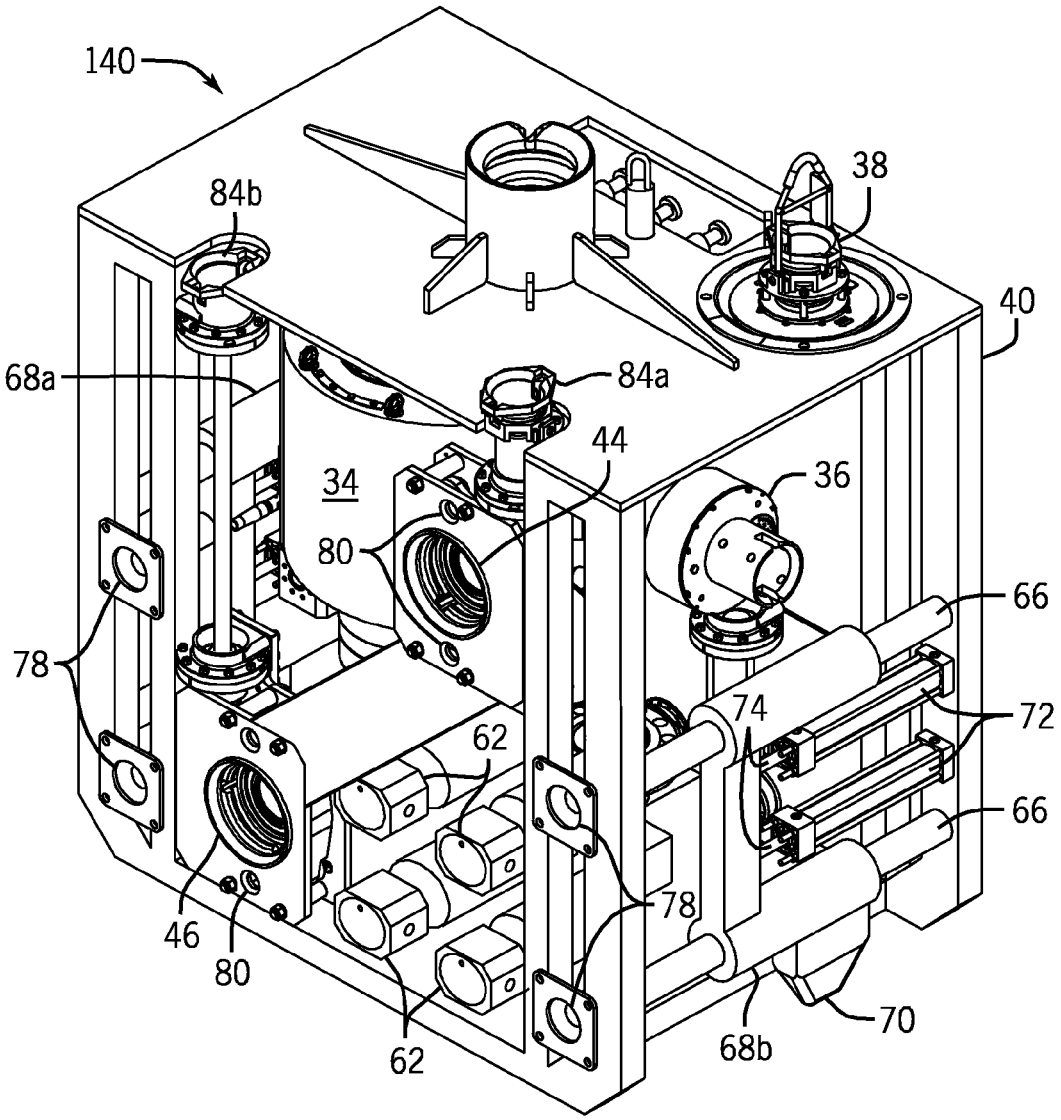
Figure 17:
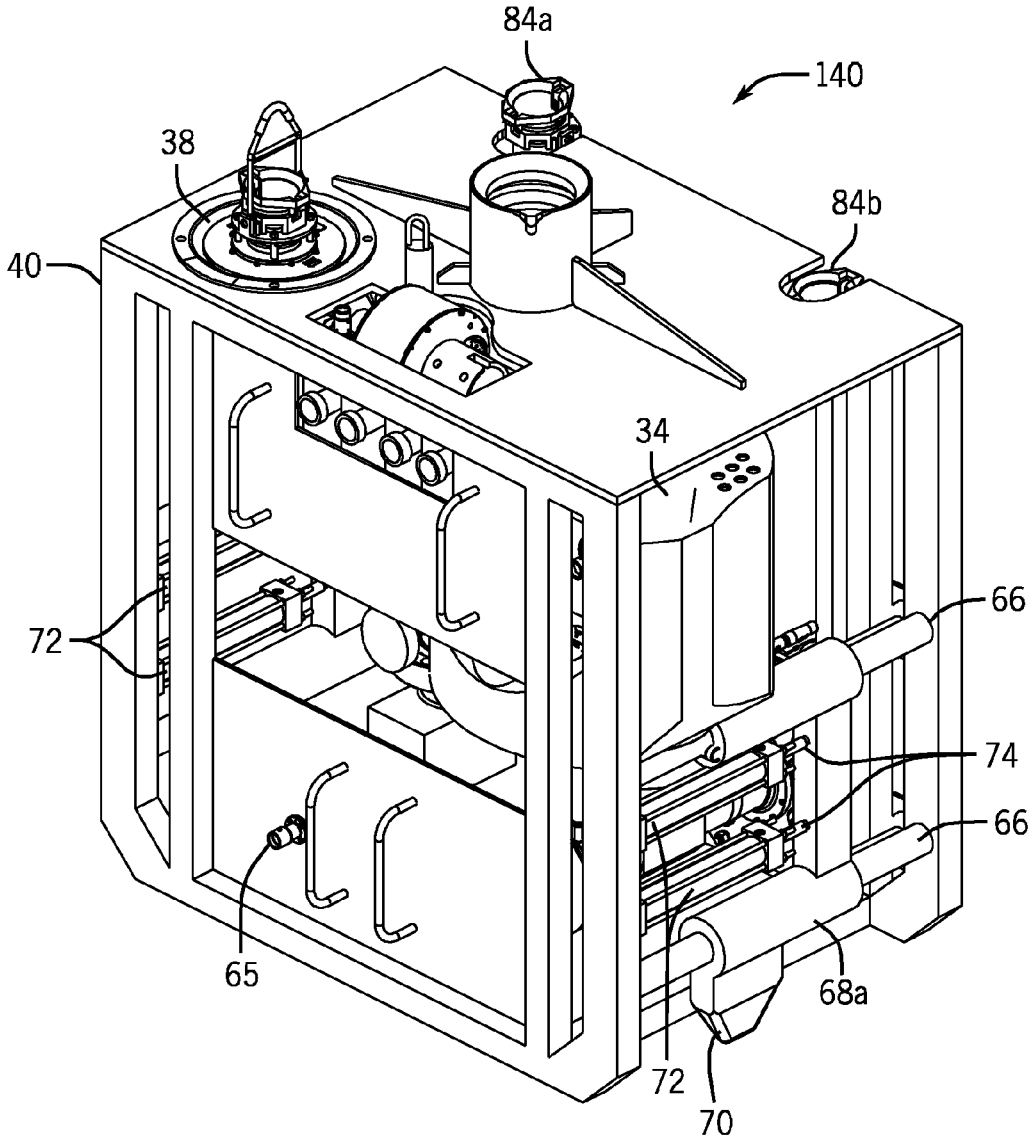

An embodiment of an RFM unit 140 that uses the arrangement of the flow meter 34 and choke 36 shown in FIG. 15 is illustrated in FIGS. 16 and 17. Specifically, FIG. 16 is a frontal perspective view of the RFM unit 140, and FIG. 17 is a rear perspective view of the RFM unit 140. While this RFM unit is referred to by reference number 140 to more clearly differentiate it from the embodiment described above in FIGS. 3 to 6, like parts have generally been labeled with like reference numbers. As shown in FIGS. 16 and 17, the RFM unit 140 includes the frame 40 within which the choke 36 and flow meter 34, as well as other components of the RFM unit 140, are arranged. For instance, the RFM unit 140 of FIGS. 16 and 17 includes the SMM unit 38, multiple chemical injection metering valves 62, communication port 65, and torque clamps 84*a* and 84*b*.

In this embodiment, the RFM unit 140 may have a footprint similar to that of the RFM unit 26 shown in FIGS. 3 to 6. Additionally, the RFM unit 140 may have a similar alignment system that includes sliding members 68*a* and 68*b* on opposing side faces of the RFM unit 140, as well as hydraulic cylinders 72 having piston rods 74, and the alignment slots 78 and 80. Thus, it should be understood that for the purposes of mating the RFM unit 140 to the tree 24 or other subsea device (e.g., a manifold), the alignment and interfacing steps described above in FIGS. 8 to 13 may be generally identical. It should also be understood that in some embodiments, the alignment system of the RFM unit 140 may include the knuckle joints 118 and 120 described above in FIG. 14, or may include only the sliding members 68 without hydraulic cylinders 72 and piston rods 74. In the latter case, a separate device, such as a running tool, may be used to facilitate movement of the RFM unit 140 toward the tree 24 during the mating process.

Figure 18:
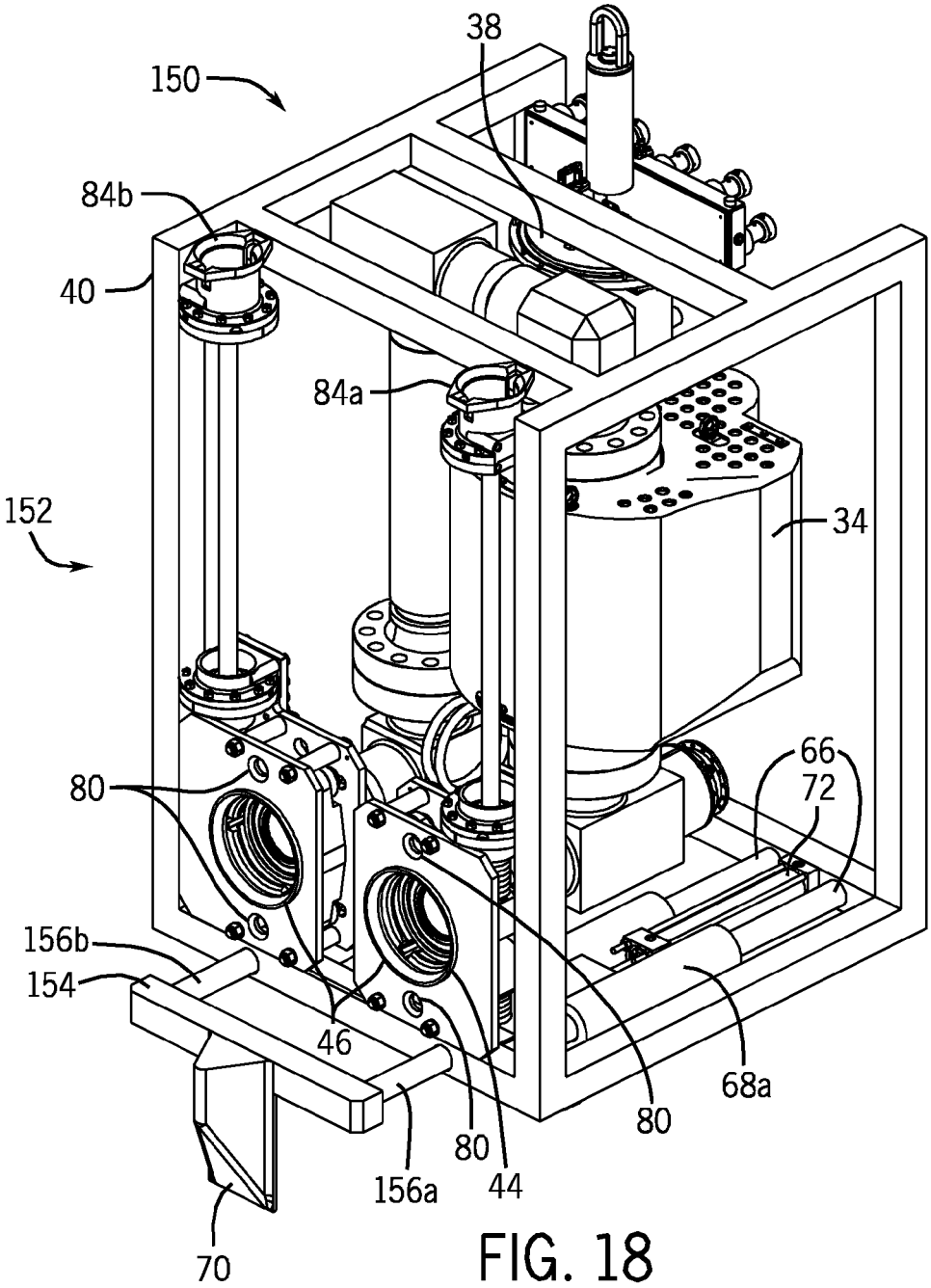
FIGS. 18 to 21 provide several views showing a third embodiment of the RFM unit.
Figure 20:
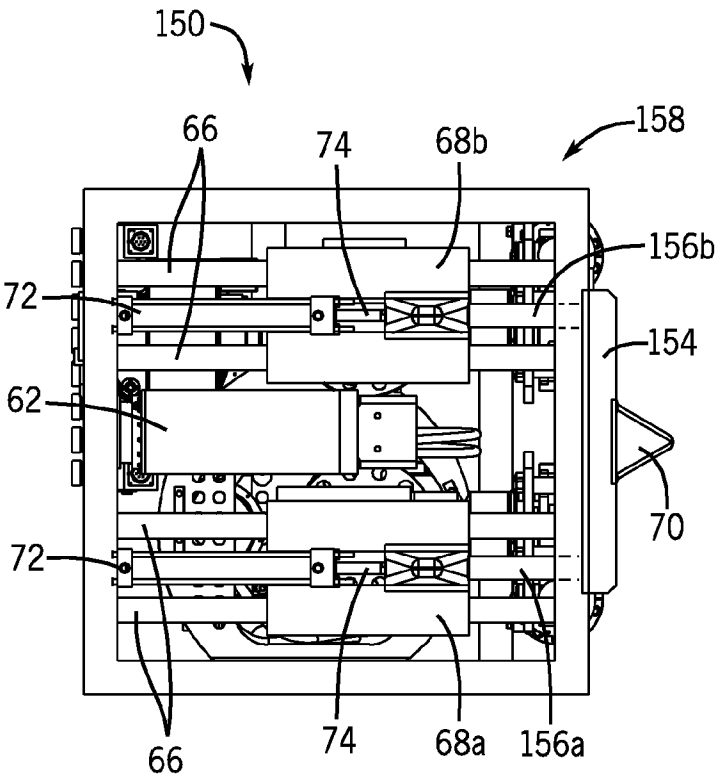
Figure 19:
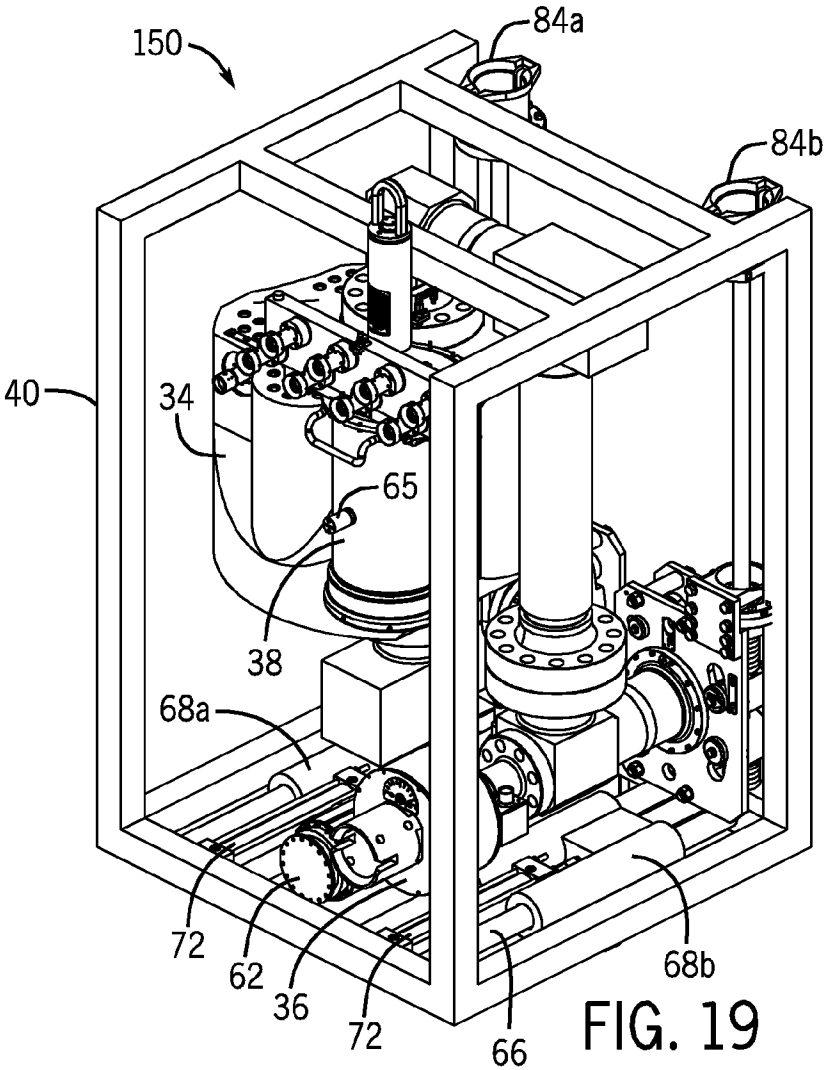
Figure 21:
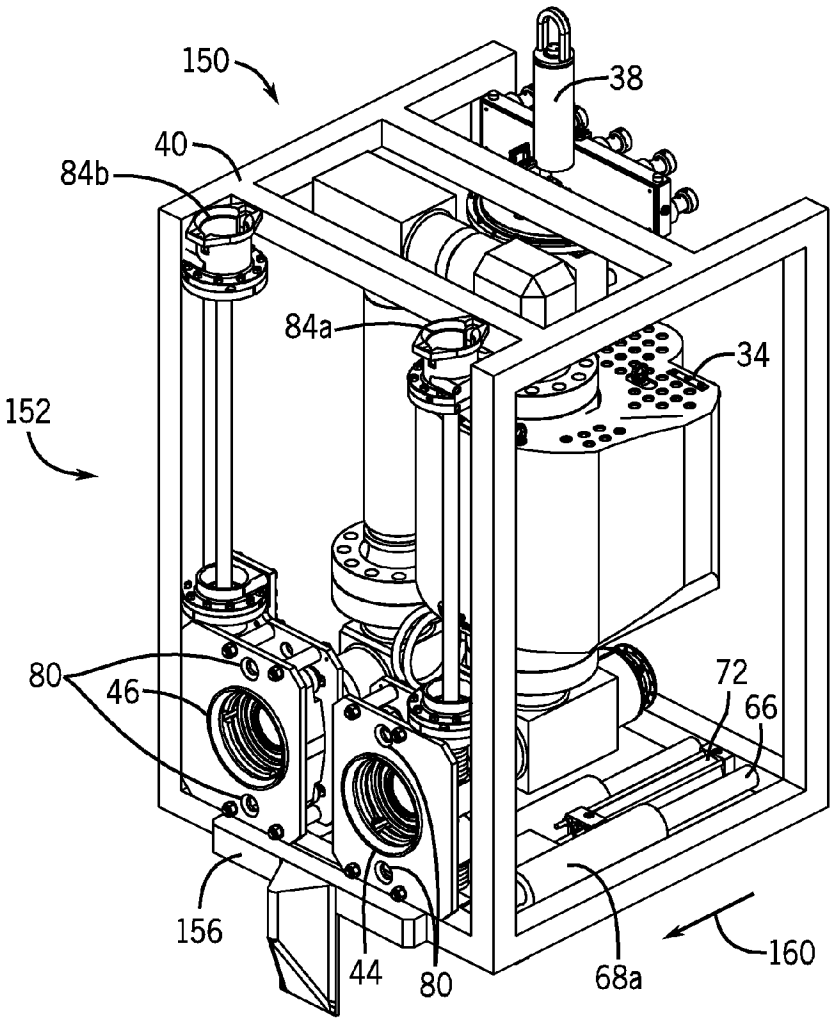

Referring now to FIGS. 18 to 21, a third embodiment of the RFM unit is illustrated and referred to by reference number 150. Specifically, FIGS. 18 and 21 are frontal perspective views of the RFM unit 150, FIG. 19 is a rear perspective view of the RFM unit 150, and FIG. 20 shows a bottom face view of the RFM unit 150. The depicted RFM unit 150 includes the flow meter 34 arranged upstream from the choke 36 (best shown in FIG. 19) with respect to the direction of fluid flow into the inlet 44 and out of the outlet 46. Of course, other embodiments of the RFM unit 150 may utilize the choke 36 upstream from the flow meter 34, as is the case with the RFM unit 140 of FIGS. 15 to 17. As shown in FIGS. 18 to 21, the RFM unit 150 includes the frame 40 within which the choke 36 and flow meter 34, as well as other components of the RFM unit 150, are arranged. For instance, the RFM unit 140 of FIGS. 16 and 17 includes the SMM unit 38, a chemical injection metering valve 62, communication port 65, and torque clamps 84*a* and 84*b*.

It should be noted that RFM unit 150 also includes an alignment system. However, in contrast to the embodiments discussed above in FIGS. 3 to 6 and FIGS. 16 to 17, the alignment system includes sliding members 68 that are disposed on the bottom face 158 of the RFM unit 150, as best shown in FIG. 20. For instance, first and second sliding members 68*a* are provided that are configured to slide along rods 66 extending across the frame 40 along the bottom face 158 when mating the RFM unit 150 to the tree 24. The alignment system of the RFM unit 150 also includes hydraulic cylinders 72 coupled to the frame 40, wherein each hydraulic cylinder 72 has a respective piston rod 74 coupled to a respective sliding member 68.

Further, as best shown in FIGS. 18 and 20, rods 156*a* and 156*b*, which extend through the frame 40, may couple the sliding members 68*a* and 68*b*, respectively, to a handle 154 that extends outwardly from the front face 152 of the RFM unit 150. The handle 154 may include at least one alignment member 70 (e.g., similar to the alignment teeth 70 described above) configured to engage an alignment slot, such as one similar to slot 102 (FIG. 9), during an alignment portion of a mating process. Such a mating process may generally be similar to that described above with reference to FIGS. 8 to 13, but may account for the alignment system being generally arranged on the bottom face 158 of the RFM unit 150 rather than opposing side faces.

For instance, the RFM unit 150 may first be lowered onto a platform (e.g., platform 100 of FIG. 8) of a tree 24, a process that may include lowering the RFM unit 150 into a guide frame (e.g., guide frame 98 of FIG. 8) with the handle 154 in an extended position as shown in FIG. 18. As the RFM unit 150 is fully lowered onto the platform, a slot 102 may receive the alignment tooth 70. When fully lowered, the hydraulic cylinders 72 may retract the piston rods 74 causing the sliding members 68*a* and 68*b* to slide in along the rods 66 in a direction 160 away from the front face 152 of the RFM unit 150. In the other words, the retracting of the piston rods 74 into their respective cylinders 72 causes the front face 152 of the RFM unit 150 to move in the direction indicated by arrow 160 toward the tree 24 (not shown in FIG. 21), which effectively results in the handle 154 transitioning from the extended position, as shown in FIG. 18, to a retracted position, as shown in FIG. 21.

In the illustrated embodiment, the RFM unit 150 includes the alignment slots 80 that may receive guide pins (e.g., guide pins 112 of FIG. 12) extending from the tree 24 to further assist with alignment prior to mating. For instance, the slots 80 may engage corresponding guide pins 112 as the front face 152 of the RFM unit 150 moves toward the tree 24. In the present embodiment, the RFM unit 150 does not include the additional alignment slots 78 on the frame 40, although other embodiments of the RFM unit 150 may additionally include such slots 78, which may engage another set of guide pins (e.g., guide pins 110 of FIG. 12) on the tree 24. When fully aligned and interfaced with the tree 24 or other subsea device (e.g., a manifold), the RFM unit 150 may be secured to the tree 24 by way of the torque clamps 84*a* and 84*b*. For instance, the clamps 84*a* and 84*b* may be actuated by a torque tool of an ROV to result in fluid coupling of the inlet 44 to a wing valve line of the tree and the outlet 46 to a flow line 106 that directs resources extracted from the well 12 to the surface. As will be appreciated, when using a dual clamp configuration, as is shown in the embodiments illustrated in the figures, the matching of tolerance stack-up for securing both the inlet 44 and outlet 46 via the actuation of their respective clamps 84 may be facilitated by having a degree of compliance or flex in the piping of the RFM unit 150 and/or in the wing valve line 104 and flow line 106.

It should be noted that the various additional features pertaining to the alignment system, as discussed above, may also be utilized with the embodiment of the RFM unit 150 shown in FIGS. 18 to 21. Namely, certain embodiments of the RFM unit 150 may include the knuckle joints 118 and/or 120 to provide additional flexibility during the alignment process. As discussed above, such knuckle joints 118 and 120 may be used in conjunction with the sliding members 68 and hydraulic cylinders 72 to provide a degree of movement that may facilitate clearing misalignments. Additionally, the RFM unit 150 may not utilize hydraulic cylinders 72 at all in some embodiments. Instead, a separate device, such as a running tool, may be utilized to facilitate movement of the RFM unit 150 toward the tree 24 during the mating process.

Further, it should be noted that because the alignment system of the RFM unit 150 is generally arranged along the bottom face 158 rather than along both opposing side faces, the RFM unit 150 may have a more compact form factor when compared to the embodiments of the RFM units 26 and 140 described above. By way of example only, the footprint of the RFM unit 150 may have a volume that is between approximately 20 to 30 percent less than that of the RFM units 26 and 140 described above.

Figure 23:
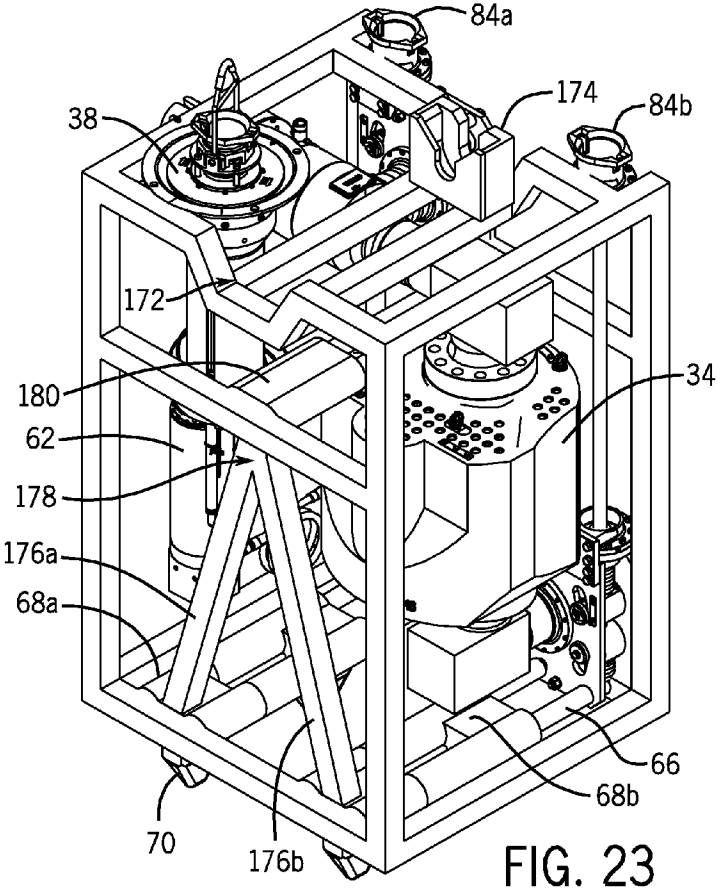
FIGS. 22 to 25 provide several views showing a fourth embodiment of the RFM unit.
Figure 22:
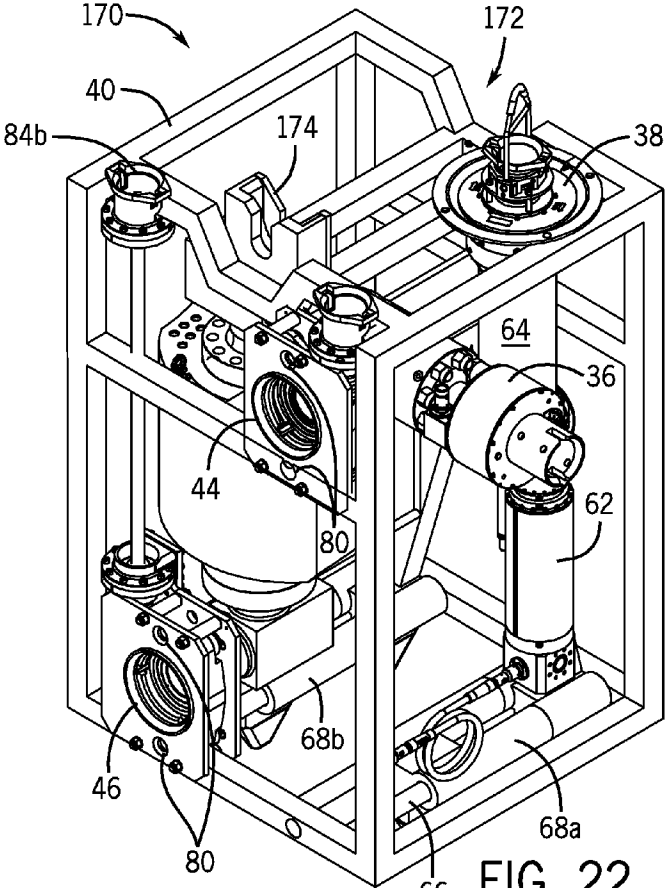
Figure 25:
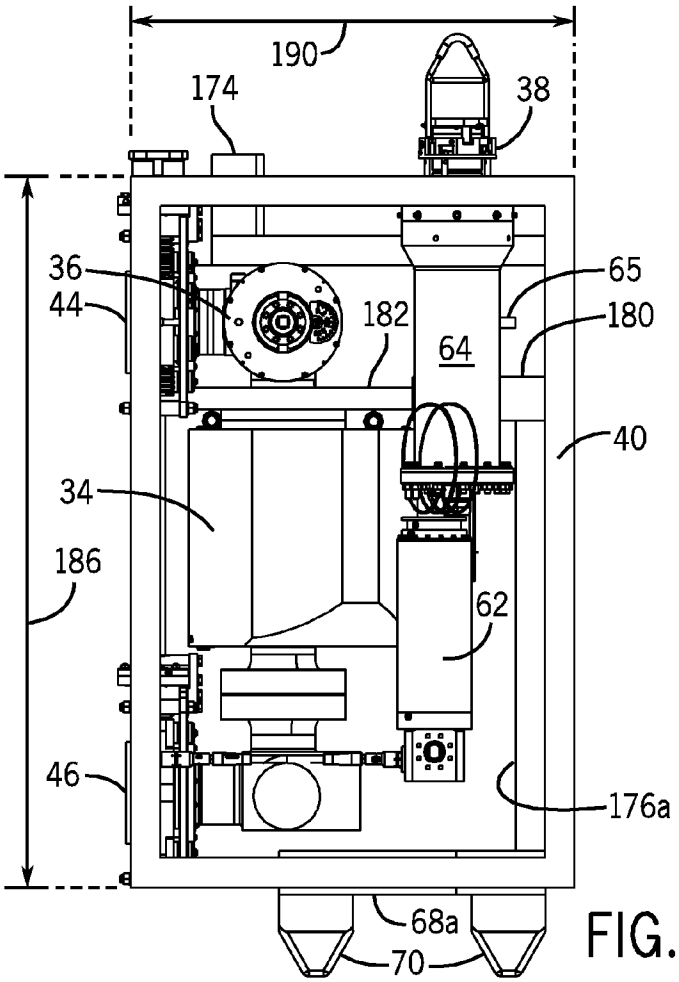
Figure 24:
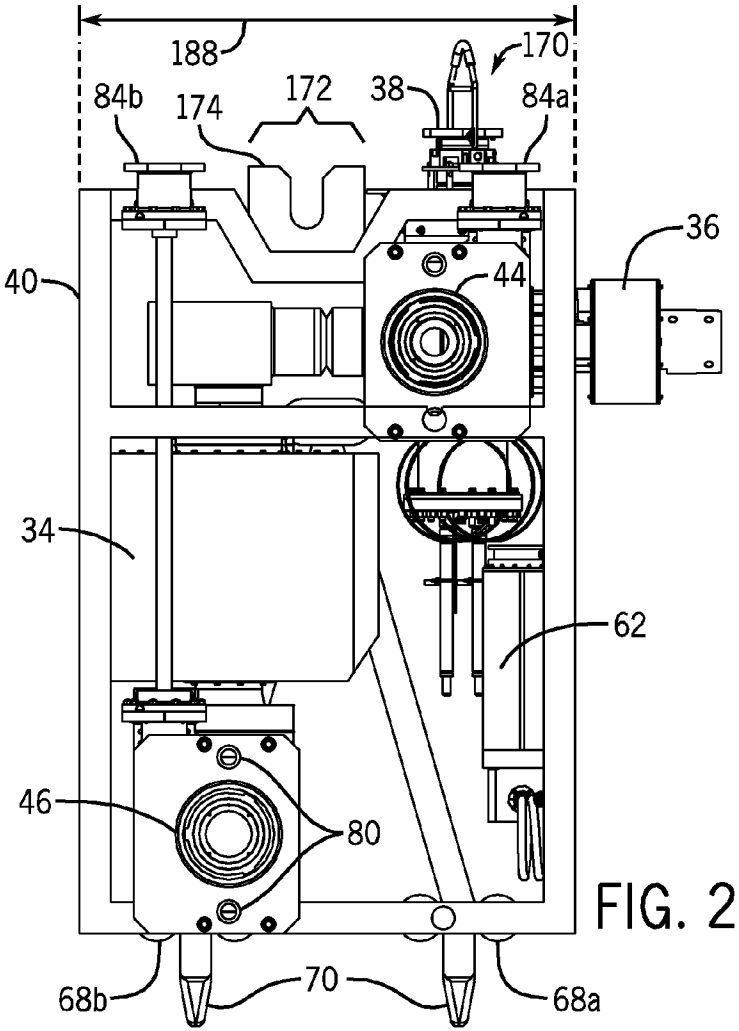

Continuing to FIGS. 22 to 25, a further embodiment of an RFM unit 170 is illustrated. Specifically, FIG. 22 shows a frontal perspective view of the RFM unit 170, FIG. 23 shows a rear perspective view of the RFM unit 170, FIG. 24 shows a front view of the RFM unit 170, and FIG. 25 shows a side view of the RFM unit 170. Particularly, these figures provide an example of an embodiment where the RFM unit 170 is configured to align and interface with a tree 24 or other subsea device (e.g., a manifold) using an alignment system without the hydraulic cylinders 72 described above. Instead, the RFM unit 170 may be aligned using the alignment system in conjunction with the assistance of a separate device, such as a subsea running tool.

The depicted RFM unit 170 includes the flow meter 34 arranged downstream from the choke 36 with respect to the direction of fluid flow into the inlet 44 and out of the outlet 46. Of course, other embodiments of the RFM unit 170 may utilize the choke 36 downstream from the flow meter 34, as is the case with the embodiments of the RFM units 26 and 150 described above with reference to FIGS. 3 to 6 and 18 to 21. As shown in FIGS. 22 to 25, the RFM unit 170 includes the frame 40 within which the choke 36 and flow meter 34, as well as other components of the RFM unit 170, are arranged. For instance, the RFM unit 170 of FIGS. 22 to 25 includes the SMM unit 38, a chemical injection metering valve 62, communication port 65 (best shown in FIG. 25), and torque clamps 84*a* and 84*b*.

In this embodiment, the RFM unit 170 includes an alignment system that lacks the hydraulic cylinders 72 described above. Instead, the RFM unit 170 may further rely on a separate running tool when interfacing the RFM unit 170 with a subsea tree 24. For instance, the RFM unit 170 may include a recess 172 within the frame 40 and a receiving block 174 configured to receive a running tool during deployment and mating. In the illustrated embodiment, the recess 172 and receiving block 174 are located on the top face of the RFM unit 170.

The alignment system includes the sliding members 68*a* and 68*b* disposed on the bottom face of the RFM unit 170 in a manner similar to that described above with reference to the RFM unit 150 of FIGS. 18 to 21. Each sliding member 68*a* and 68*b* may include one or more alignment teeth 70 configured to engage a respective alignment slot on the tree 24 or other subsea device during the mating process. It should be noted, however, that the sliding members 68*a* and 68*b*, while being configured to slide along the rods 66 disposed across the frame 40 on the bottom face of the RFM unit 170, lack the hydraulic cylinders 72 and piston rods 74 discussed in some of the embodiments above.

As shown best in FIG. 23, angled beams 176*a* and 176*b* that converge at a common point 178 may couple the sliding members 68*a* and 68*b*, respectively, to an additional sliding member 180 located generally within the region enclosed by the frame 40. As best shown in FIG. 25, the sliding member 180 may be configured to slide along one or more rods 182 that extend through the region enclosed by the frame 40. Thus, during the mating process, the sliding members 68*a*, 68*b*, 180 and the angled beams 176*a*, 176*b* may collectively form an integral sliding mechanism that is configured to facilitate movement of the RFM unit 170 toward the tree 24 during the mating process with the assistance of a running tool, as will be discussed in more detail below. Once the RFM unit 170 is interfaced with the tree 24, the running tool may be removed from the RFM unit 170, such as by using an ROV, and returned to the surface.

Like the RFM unit 150 discussed above with reference to FIGS. 18 to 21, the dimensions of the RFM unit 170 may provide for a form factor having a volume that is less than that of the RFM units 26 (FIGS. 3 to 6) and 140 (FIGS. 15 to 17) (e.g., between approximately 20 to 30 percent less in some embodiments). For instance, referring to FIGS. 24 and 25, the RFM unit 170 may have a height 186 of between approximately 90 to 100 inches, a width 188 of between approximately 60 to 70 inches, and a depth 190 of between approximately 50 to 70 inches (excluding the slight protrusion of certain components beyond the frame 40 of the RFM unit 170), thus providing for a volume of between approximately 270,000 to 490,000 cubic inches (approximately 156 to 284 cubic feet). In one particular embodiment, the RFM unit 170 may have a height 186 of approximately 96 inches, a width 188 of approximately 64 inches, and a depth 190 of approximately 60 inches, resulting in a volume of approximately 368,640 cubic inches or 213 cubic feet.

Similar to the RFM unit 150 discussed above, the reduced form factor when compared to the RFM units 26 and 140 may be at least partially attributed to the sliding members 68*a*, 68*b* being arranged along a bottom face of the RFM unit 170 rather than on opposite side faces. It should also be understood that in some embodiments, the alignment system of the RFM unit 170 may include the knuckle joints 118 and 120 described above in FIG. 14 to further facilitate alignment, as well as to help clear misalignments. Additionally, despite exhibiting similar dimensions to the RFM unit 150, the RFM unit 170 may also exhibit reduced weight since the alignment system does not include certain components, namely the hydraulic cylinders 72 and their respective piston rods 74. Accordingly, this illustrated embodiment may provide a smaller and lighter standalone assembly which further increases the ease of deployment and retrieval of the RFM unit 170.

Figure 26:
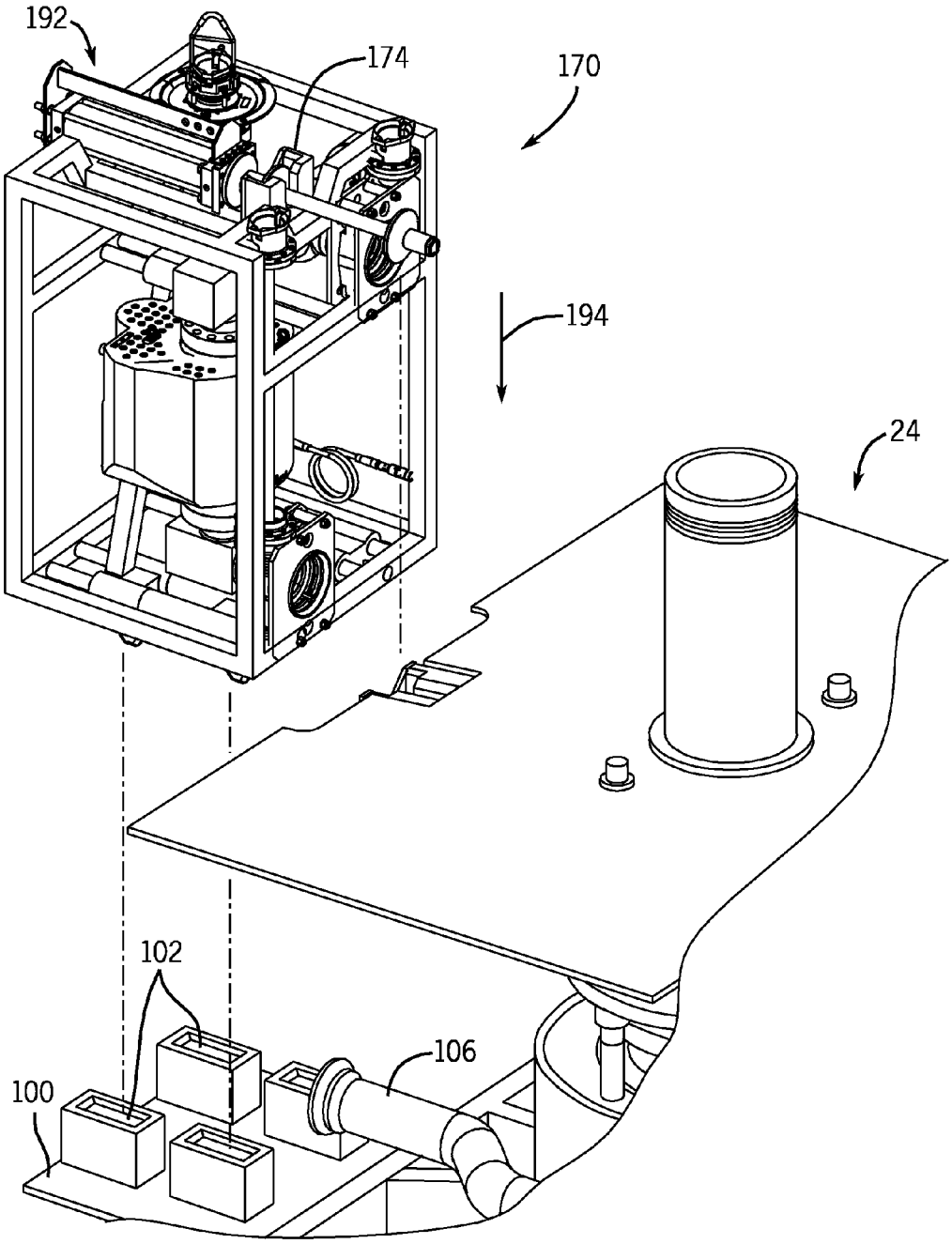
FIGS. 26 to 32 illustrate various steps for aligning and interfacing the RFM unit shown in FIGS. 22 to 25 with a subsea production tree with the assistance of a running tool in accordance with an embodiment of the present invention.
Figure 27:
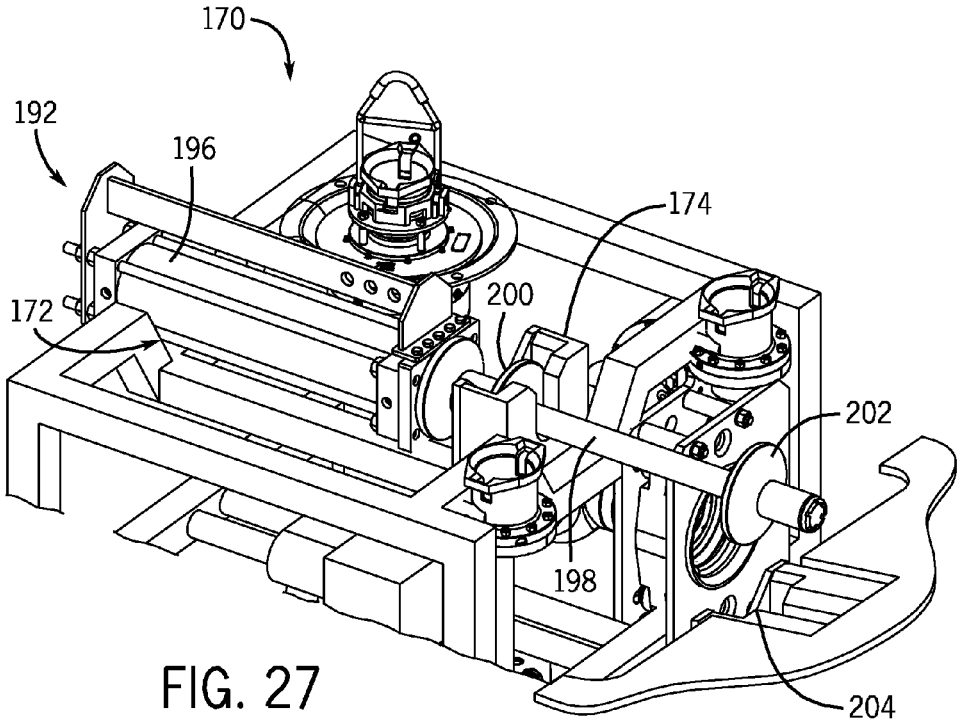
Figure 28:
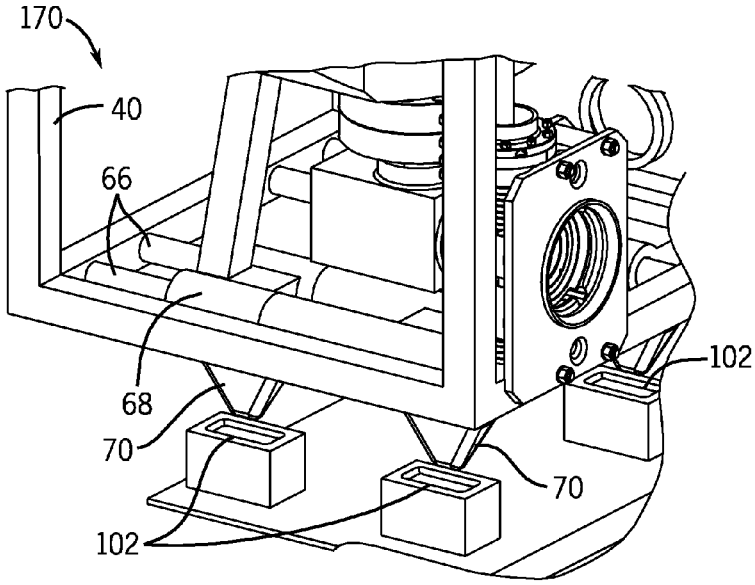
Figure 29:
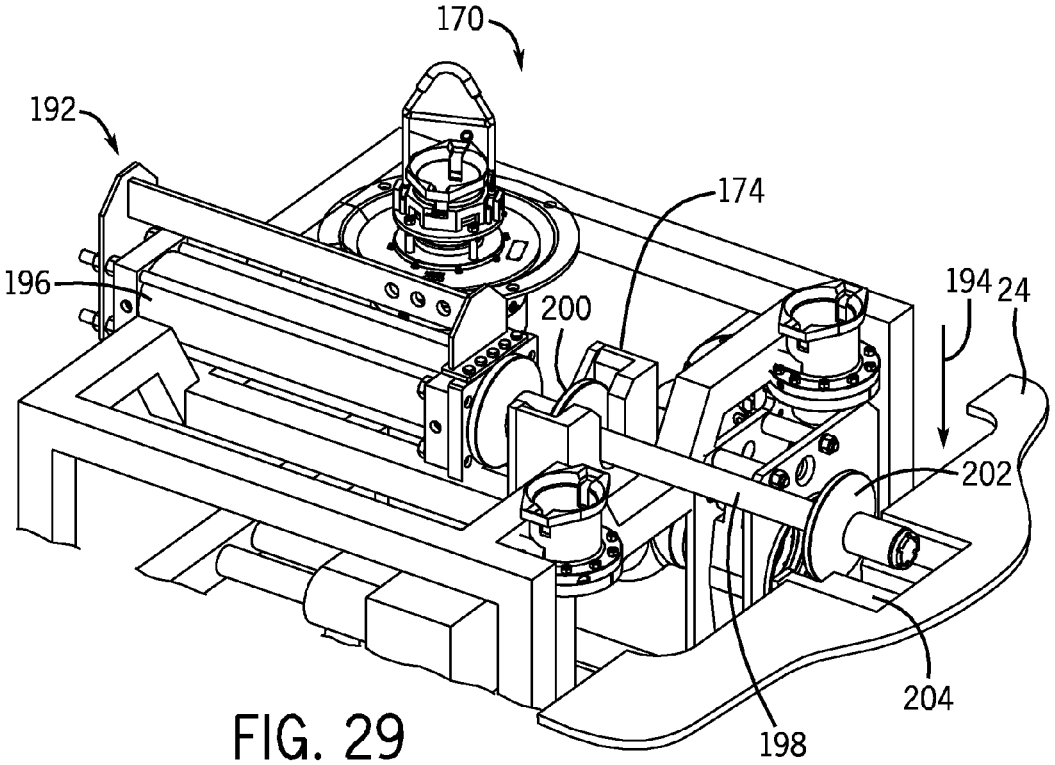
Figure 30:
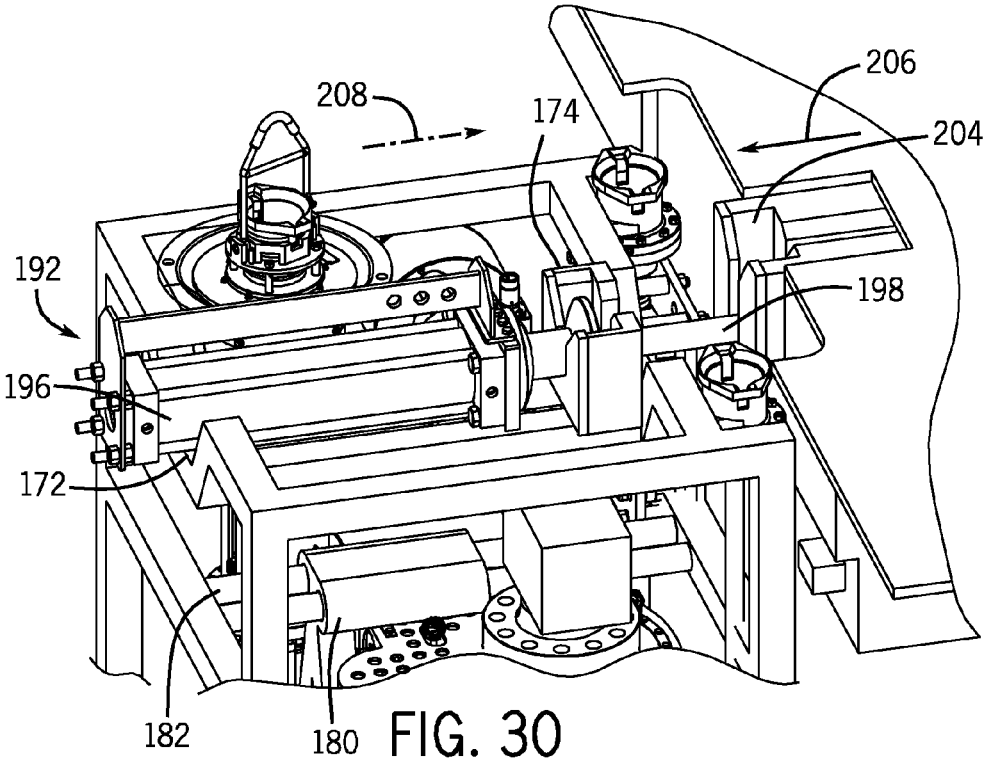

A mating process for aligning and interfacing the RFM unit 170 with a subsea Christmas tree 24 is described in greater detail with reference to FIGS. 26 to 32. In particular, the mating process includes the use of a running tool 192 in conjunction with the RFM unit 170 for facilitating the mating process. For example, referring first to FIGS. 26 and 27, the RFM unit 170 with the running tool 192 is shown being lowered (indicated by arrow 194) to the docking platform 100 of the tree 24. The platform 100 may include a set of alignment slots 102 for receiving the alignment teeth 70 extending from the sliding members 68 of the RFM unit 170, as best shown in FIG. 28. Further, while the platform 100 shown in embodiment of FIG. 26 does not include a guide frame (e.g., frame 98), other embodiments may include a guide frame for providing an additional degree of alignment when lowering the RFM unit 170 to the platform 100.

Referring again to FIG. 27, the running tool 192 may be installed on the RFM unit 170 in a removably coupled manner by way of the recess 172 and receiving block 174. Essentially, the running tool 192 may function in a manner similar to the hydraulic cylinders 72 described in some of the embodiments above. For example, the running tool 192 also includes a hydraulic cylinder 196. The hydraulic cylinder 196 includes a piston rod 198 that extends outwardly from a flange 200 at one end of the cylinder 196 which is configured to engage the receiving block 174. The distal end of the piston rod 198 may include a flange 202 that is configured to engage a receiving block 204 of the tree 24 as the RFM unit 170 is lowered onto the platform 100, as shown best in FIG. 29. In some embodiments, the RFM unit 170 may also be initially lowered onto the platform 100 without the running tool 192 installed. In this case, the running tool 192 may be installed after the RFM unit 170 is lowered onto the platform 100, such as by using an ROV. By way of example only, the running tool 192 may be of a model manufactured by Cameron International Corporation.

Once the RFM unit 170 is fully lowered onto the platform 100 (e.g., with each of the alignment teeth 70 being fully seated into a respective alignment slot 102 and the flange 202 of the running tool 192 engaged by the receiving block 204) the running tool 192 can retract the piston rod 198 into the hydraulic cylinder 196 in the direction indicated by arrow 206. However, because the flange 202 of the piston rod 198 is secured by the receiving block 204 on the tree, the retraction of the piston rod 198 effectively causes the running tool 192 the RFM unit 170 to move toward the tree 24, as indicated by directional arrow 208. Accordingly, because the flange 200 is engaged by receiving block 174 of the RFM unit 170, the retraction of the piston rod 198 essentially pulls the RFM unit 170 toward the tree 24 (in direction 208).

In the illustrated embodiment, the RFM unit 170 includes the alignment slots 80 that may receive guide pins 112 (not shown) extending from the tree 24 to further assist with alignment prior to mating. For instance, the slots 80 may engage corresponding guide pins 112 as the front face of the RFM unit 170 moves in direction 208 toward the tree 24. Further, while the present embodiment of the RFM unit 170 does not include the additional alignment slots 78 on the frame 40, other embodiments may include such slots 78 for engaging another set of guide pins (e.g., such as guide pins 110 of FIG. 12) on the tree 24.

Figure 31:
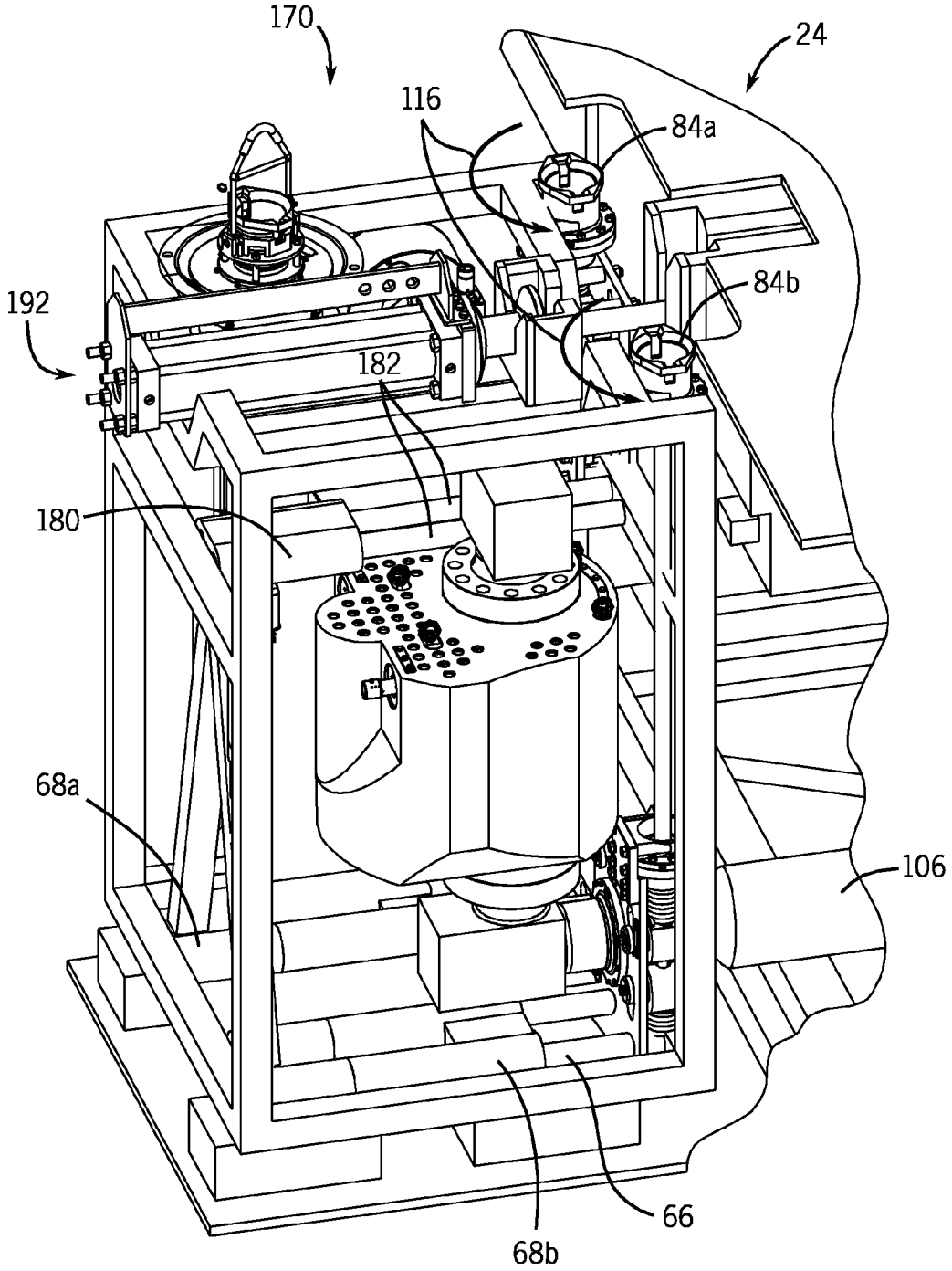
Figure 32:
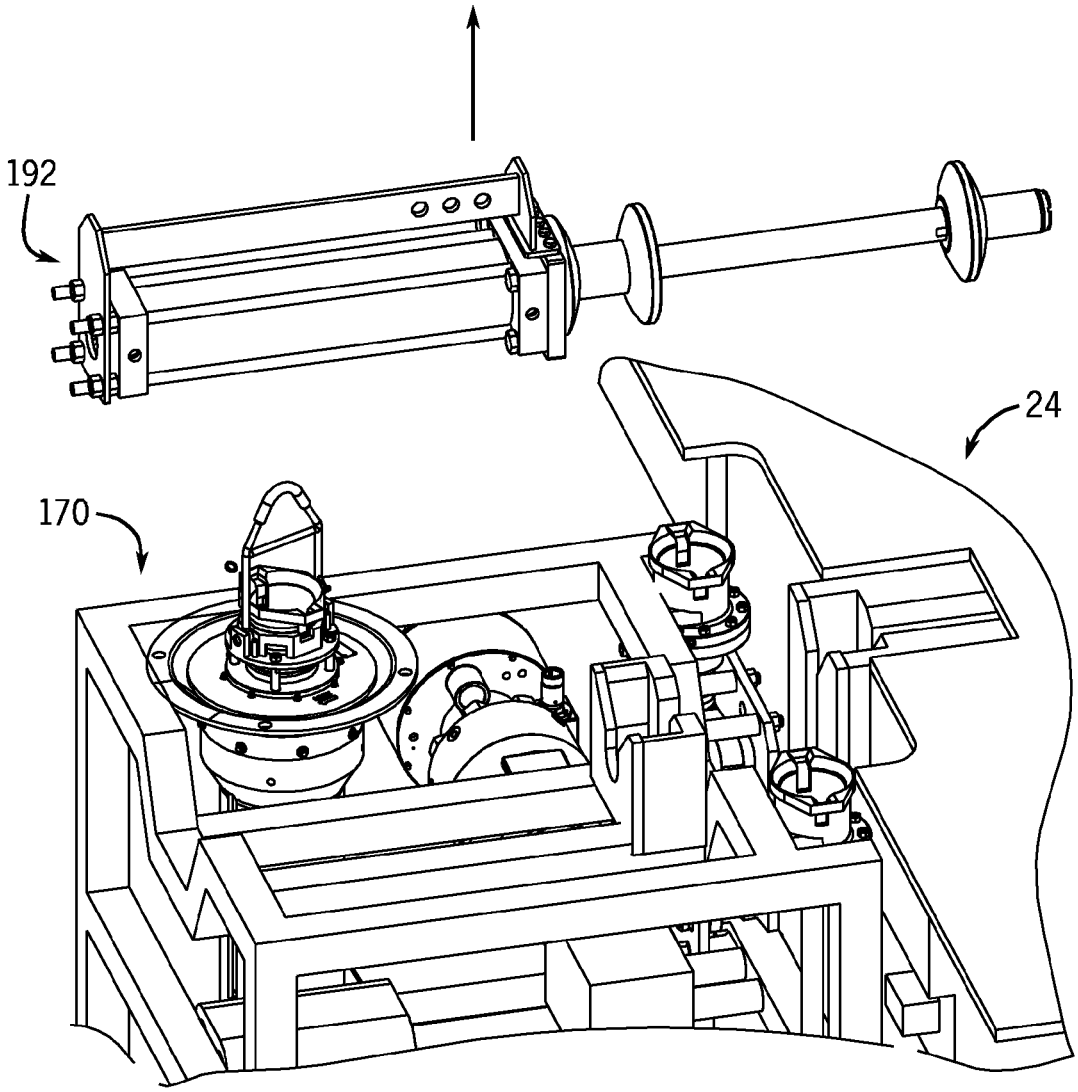

As this movement in direction 208 occurs, the sliding mechanism (formed collectively by elements 68, 176, and 180) will remain generally stationary relative to the tree 24 due to the engagement of the alignment teeth 70 with the alignment slots 102 on the platform 100, as shown above in FIG. 28. Thus, as the RFM unit 170 moves in the direction 208, the sliding members 68 and 180 will appear to slide away from the front face of the RFM unit 170 (along rods 66 and 182 of frame 40) relative to the position of the RFM unit 170. Accordingly, once the RFM unit 170 is fully aligned and interfaced with the tree 24, the sliding mechanism may have transitioned from an initial pre-alignment position, as shown in FIGS. 26 to 28, to an aligned position, as shown in FIG. 31. The torque clamps 84*a* and 84*b* may then be actuated, such as by way of a torque tool of an ROV, to securely mate the RFM unit 170 to the tree 24. For instance, actuation of these torque clamps 84*a* and 84*b* may couple the inlet 44 to a wing valve line 104 (not visible in FIG. 31) of the tree 24 and the outlet 46 to a flow line 106, respectively. Finally, as shown in FIG. 32, after the mating process is completed, the running tool 192 may be removed from the RFM unit 170 and returned to the surface. In this embodiment and the embodiment of the RFM unit 150 discussed above, the more compact frame 40 (when compared to the embodiments of the RFM units 26 and 140 discussed above) may allow better access to stud threads of the torque clamps 84*a* and 84*b*. Accordingly, an ROV may be used to cut the stud threads, such as by flame cutting, if the stud threads seize or otherwise malfunction, thus providing a secondary method of unlocking the torque clamps 84.

As can be seen from the examples illustrated throughout the various figures described above, the RFM unit embodiments of the present disclosure provide for the collocation of several smart components into a relatively compact and standalone assembly that may include flow monitoring and control elements while easily accommodating ancillary items, such as chemical injection metering valves, sensors, etc., all of which may otherwise be distributed at different locations and/or assemblies on some conventional subsea Christmas trees. Further, in some embodiments, additional elements that would normally be configured a tree, such as a gas lift choke and its associated flow meter, may also be located on the RFM unit 26.

Thus, the retrieval and deployment of such elements is greatly facilitated since the RFM unit (e.g., 26, 140, 150, and 170) may be retrieved and bought to the surface or deployed in a single operation. For instance, in a retrieval operation, the various RFM units described above, referred to now generically by reference number 26, may be undocked from the tree 24 by first releasing the connection made by the torque clamps 84*a* and 84*b*. In the various embodiments above, the RFM unit 26 is then moved in a direction away from the tree 24. Depending on the configuration of the alignment system of the RFM unit 26, this may include extending piston rods 74 from the hydraulic cylinders 72 or extending the piston rod 198 from the removably installed running tool 192. Thereafter, the RFM unit 26 may be removed from the platform 100 and bought to the surface for servicing, which may include the maintenance, repair, and/or replacement of one or more components. The RFM unit 26 may also be temporarily removed from a tree 24 for offshore transport (e.g., on a barge or vessel) or onshore transport. Further, the reduced footprint and weight of the RFM unit 26 also allows for smaller cranes and/or barges to be used during the transport process. Due to this more compact and lighter design, additional transport windows (which are typically weather dependent) for offshore delivery and installation of subsea production trees may be available.

Figure 33:
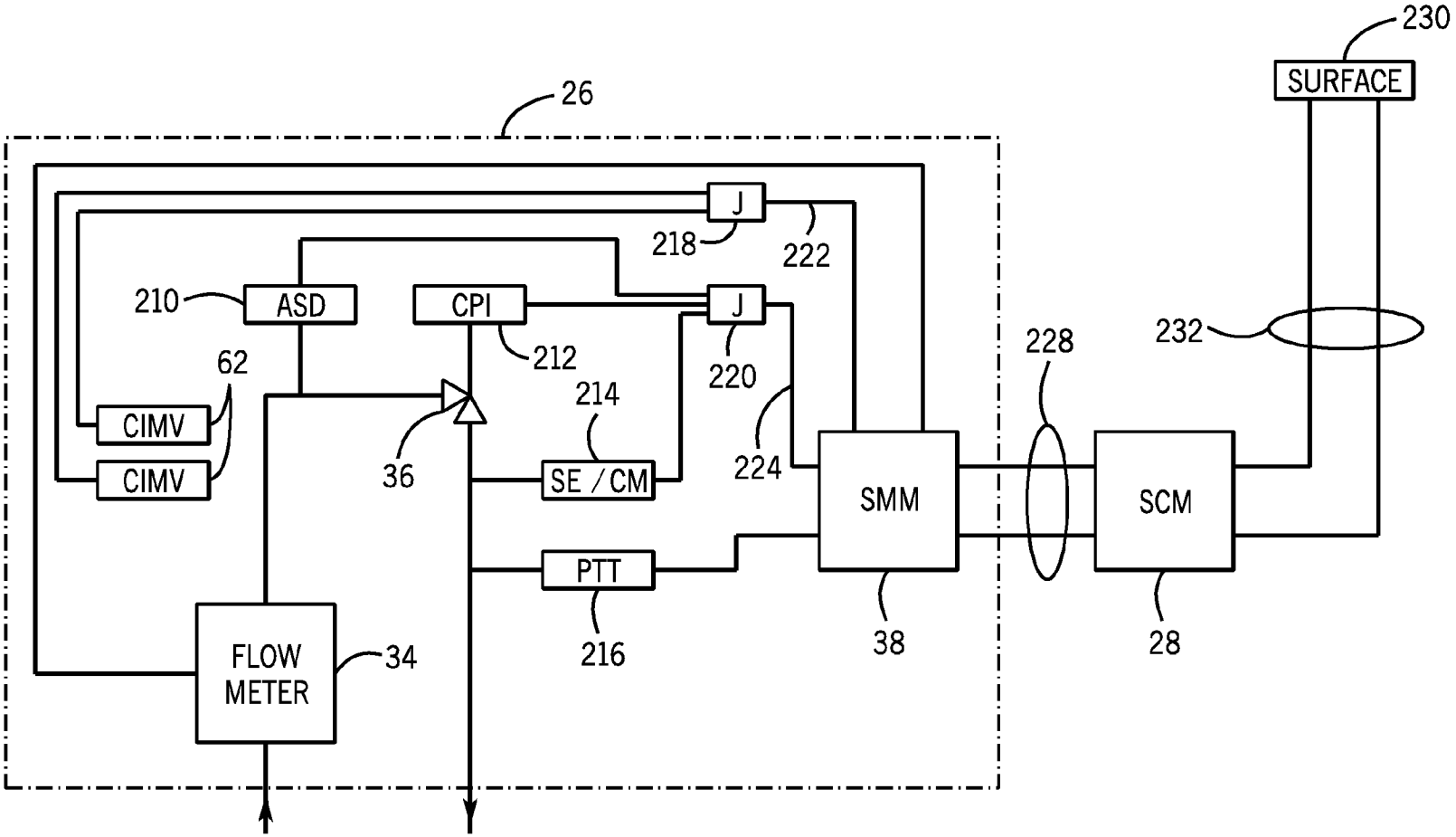
FIG. 33 is a block diagram of a subsea system having an RFM unit that includes a subsea monitoring module (SMM) in communication with a subsea control module, wherein the SMM unit employs a non-integrated configuration in accordance with one embodiment.

Having described several embodiments of the RFM unit 26 in the foregoing figures, the configuration of the subsea monitoring module (SMM) 38 will be described in more detail below. Referring first to FIG. 33, a block diagram of the RFM unit 26 is shown, with the representation of certain components, such as flow meter 34 and choke 36, being simplified. In addition to the flow meter 34 and choke 36, the RFM unit 26 includes one or more chemical injection metering valves 62, as well as an arrangement of sensors, including an acoustic sand detection sensor (ASD) 210, a choke position indictor (CPI) 212, a sand erosion/corrosion monitor (SE/CM) 214, and a pressure and temperature transducer (PTT) 216.

Each of these components may provide operational data to the SMM unit 38. In the illustrated embodiment, junction boxes 218 and 220 are additionally provided and may be configured to act as an interface hub between the SMM unit 38 and multiple components of the RFM unit 26. For instance, the junction box 218 may receive signals from the chemical injection metering valves 62 and provide those signals to the SMM unit 38, as indicated by the signal path 222. Similarly, the junction box 220 may receive signals from the ASD 210, CPI 212, and SE/CM sensors 214 and provide those signals to the SMM unit 38. The flow meter 34 and PTT 216 are shown as providing signals directly to the SMM unit 38 in the present embodiment.

The SMM unit 38 may be communicatively coupled to the subsea control module 28 by way of the signal lines 228. For instance, as discussed above, the signal lines 228 may represent one or more cable harnesses that interface a communication port 65 on the RFM unit 26 to a corresponding port on the control module 28, thus allowing for the exchange of data signals between the RFM unit 26 and the subsea control module 28. In one embodiment, the signals lines 228 may be configured to transmit both power and data. For example, the signal lines 228 may provide a 24V DC signal to power the SMM unit 38 and/or other components of the RFM unit 26, while also providing for a data transfer protocol, such as a controller area (CANBUS) networking bus protocol.

Accordingly, the SMM unit 38 may receive and process data provided by the various sensors and components of the RFM unit 26 and provide the processed data to the subsea control module 28 by way of the signal lines 228. The subsea control module 28 may provide for electronic and hydraulic control of various tree components, and may itself be mounted on the tree 24. The various signals relating to the operation of the tree 24, including those provided to the subsea control module 28 by the SMM unit 38, may be transmitted to the surface 230 by way of signal lines 232, which may function to provide a data communication path and power.

Figure 34:
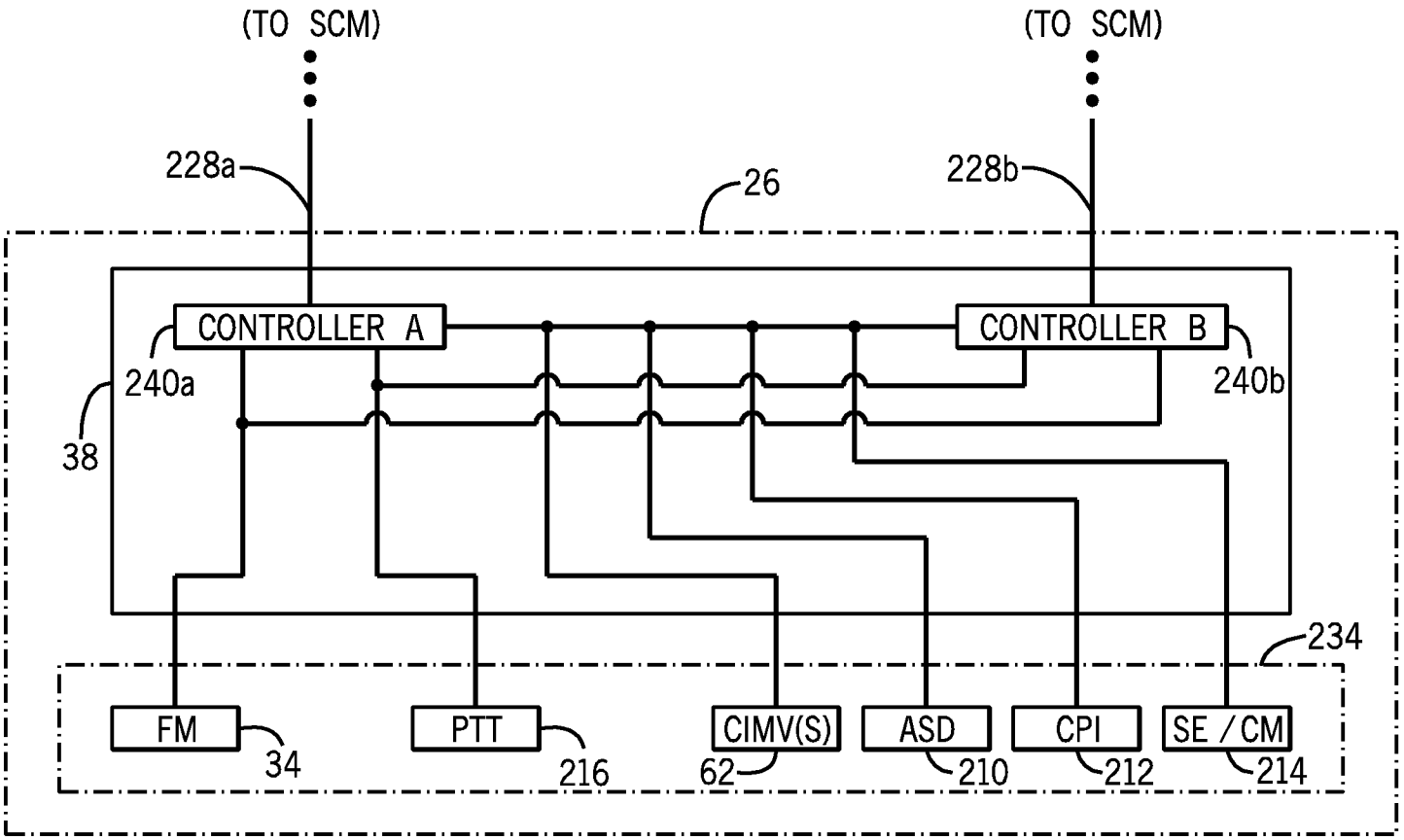
FIG. 34 is a block diagram depicting the SMM unit of FIG. 33 in more detail.

FIG. 34 is an electronic block diagram depicting the SMM unit 38 in more detail in accordance with the embodiment shown in FIG. 33. The various sensors and components of the RFM unit 26 have been collectively referenced by reference number 234. Here, the SMM unit 38 includes controllers 240*a* and 240*b*, which may be configured to provide for dual redundancy. Thus, each element of the sensing and control elements 234 may be coupled to both of the controllers 240*a* and 240*b*, as shown in FIG. 34. In operation, both controllers 240*a* and 240*b* may function to concurrently process data and transmit it to the subsea control module 28 via the signal lines 228*a* and 228*b*, respectively. In this manner, data may continue to be transmitted to the subsea control module 28 even if one of the controllers 240*a* or 240*b* fails during operation. Further, because of this redundant configuration, data from both controllers 240*a* and 240*b* may be analyzed, wherein significant discrepancies may provide for advanced detection of a defect or failure in a sensor, flow component, or even one of the controllers themselves.

As can be appreciated, each controller 240 may include processing logic (e.g., a microprocessor or application specific integrated circuit (ASIC)), memory for storing one or more control algorithms, power distribution circuitry for distributing power to electronic components of the RFM unit 26, and input/output circuitry. With respect to the configuration of the SMM unit 38 shown in FIGS. 33 and 34, this configuration may be referred to as a "non-integrated" configuration. That is, while the SMM unit 38 processes and provides data from the RFM unit 26 to the subsea control module 28, the subsea control module 28 still functions are the primary interface for communication with the surface 230.

An "integrated" configuration in which the SMM unit 38 is configured as the primary interface for surface communication is further illustrated and described below with reference to FIGS. 35 and 36. In this embodiment, certain electrical control and communication elements of the subsea control module 28 may be incorporated into the SMM unit 38, leaving certain sensors, such as an annulus pressure transmitter (APT) 244, pressure and temperature transducer (PTT) 246, and hydraulic control elements 242 external to the RFM unit 26. The SMM unit 38 is otherwise still configured to receive and process data received from the sensing and control elements 234. However, the SMM unit 38 also receives signals from the APT 244 and PTT 246 sensors and the hydraulic control module 242, which may be part of the subsea control module 28. The communication between these components and the SMM unit 38 may be by way of power/data lines, such as a 24V DC/CANBUS line, which may be provided as one or more electrical cable harnesses.

Figure 35:
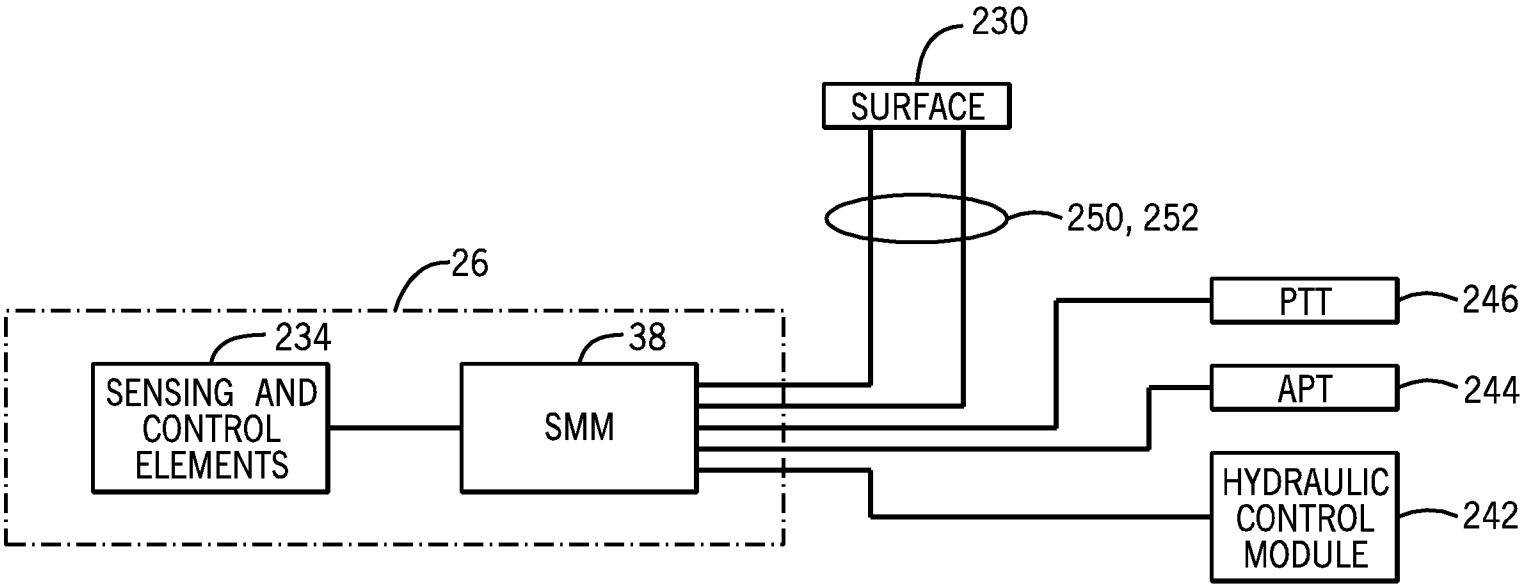
FIG. 35 is a block diagram of a subsea system having an RFM unit that includes an SMM unit employing an integrated configuration in accordance with a further embodiment.
Figure 36:
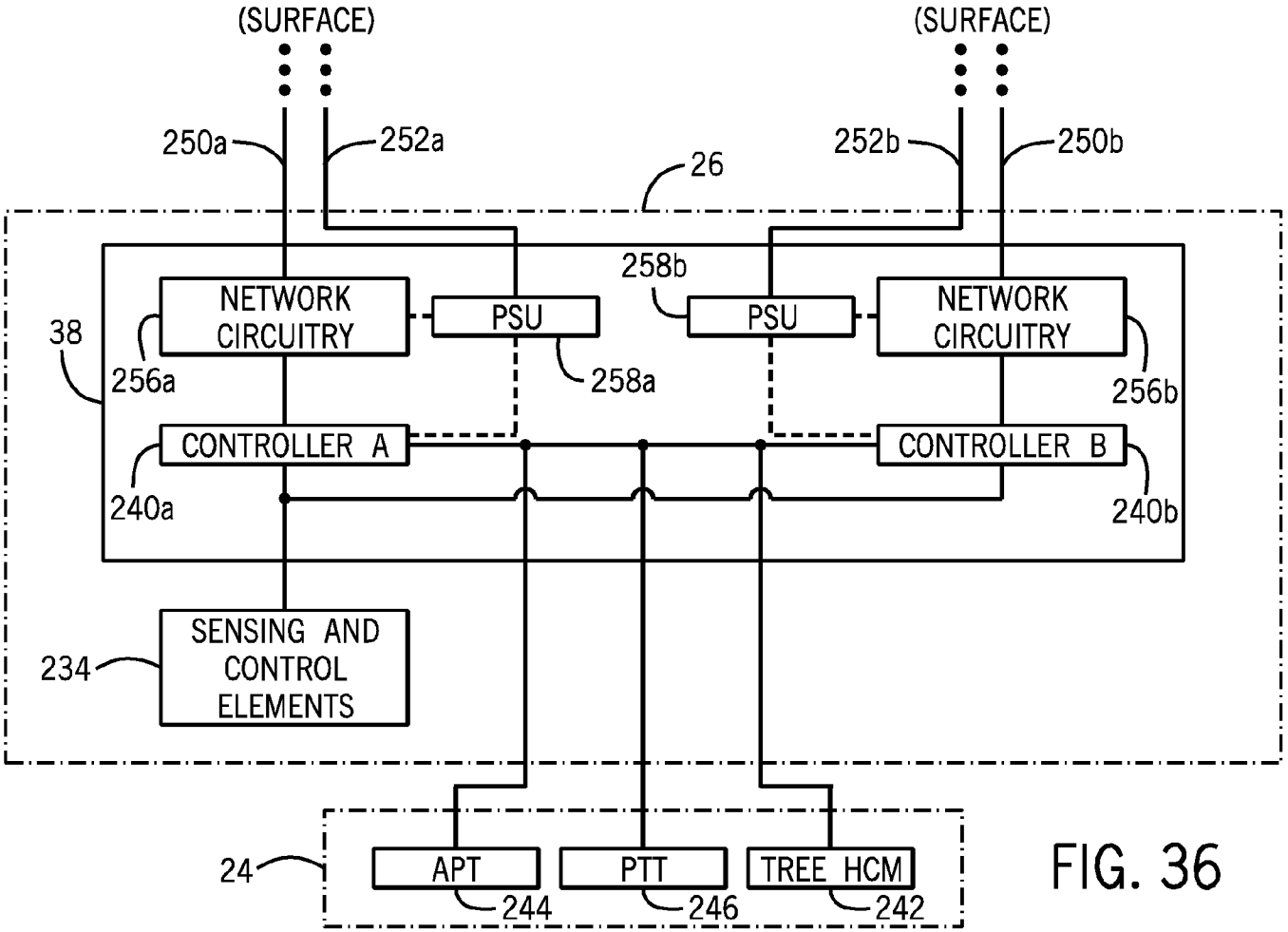
FIG. 36 is a block diagram depicting the SMM unit of FIG. 35 in more detail.

The SMM unit 38, when implemented using the illustrated integrated configuration shown in FIG. 35, may be communicatively coupled to the surface 230 by way of communication lines 250. The surface 230 may also provide power to the SMM unit 38 by way of medium to high voltage power lines 252. Referring to FIG. 36, the SMM unit 38 includes the controllers 240*a* and 240*b* that may operate in a redundant manner, as described above. As shown, the sensing and control elements 234 of the RFM unit 26 and the APT 244, PTT 246, and hydraulic control module 242 of the tree 24 may each be configured to provide data to both controllers 240*a* and 240*b*.

In this integrated configuration, each controller 240*a* and 240*b* may be coupled to respective networking circuitry 256*a* and 256*b*. The networking circuitry 256*a* and 256*b* may be coupled to communication lines 250*a* and 250*b* to enable the transmission of data between the RFM unit 26 and the surface 230. Though shown separately from the controllers 240, the networking circuitry 256 may be part of the controller 240 in some embodiments. The integrated SMM unit 38 of FIG. 36 also includes power supply units 258*a* and 258*b* that may be configured to receive power from the surface by way of the power lines 252*a* and 252*b*, respectively. These power supply units 258 may be configured to provide power to the networking circuitry 256 and controllers 240, as shown in FIG. 36. As can be appreciated, the integrated approach shown here may further collocate certain control, communications, and monitoring elements of the tree within the standalone assembly of the RFM unit 26, thus further facilitating the retrieval of sensitive components of the subsea tree 24, such as for maintenance or replacement purposes. As can be appreciated, either of the integrated or non-integrated configurations discussed herein may be applied to the various embodiments of the RFM units described with reference to the figures above.

The RFM unit 26 of the present disclosure also offers additional advantages with respect to the manner in which it interfaces with a subsea tree 24. For one, the collocation of the flow control and monitoring elements and ancillary components (chemical injection metering valves, sensors, etc.) into a standalone assembly may reduce the overall size and weight of the tree 24. Additionally, in each of the various embodiments disclosed above, the RFM unit 26 may exhibits a horizontal deployment configuration. That is, the RFM unit 26 is configured to connect to the tree 24 horizontally. For example, the inlet 44 and outlet 46 are configured to couple directly to horizontally-oriented fluid lines of the tree 24, namely the wing valve line 104 and flow line 106. This may reduce the number of bends in the fluid conduits of the (typically piping) of the RFM unit 26 and tree 24, thereby reducing erosion prone areas.

Figure 38:
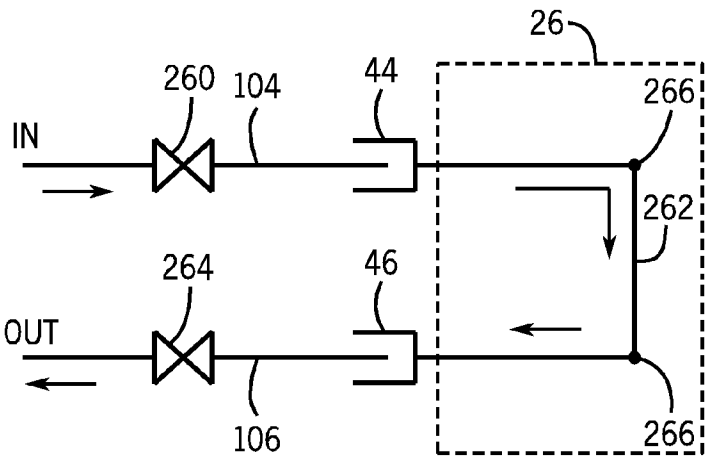
FIGS. 37 and 38 are simplified block diagrams that contrast RFM units having vertical and horizontal deployment configurations.
Figure 37:
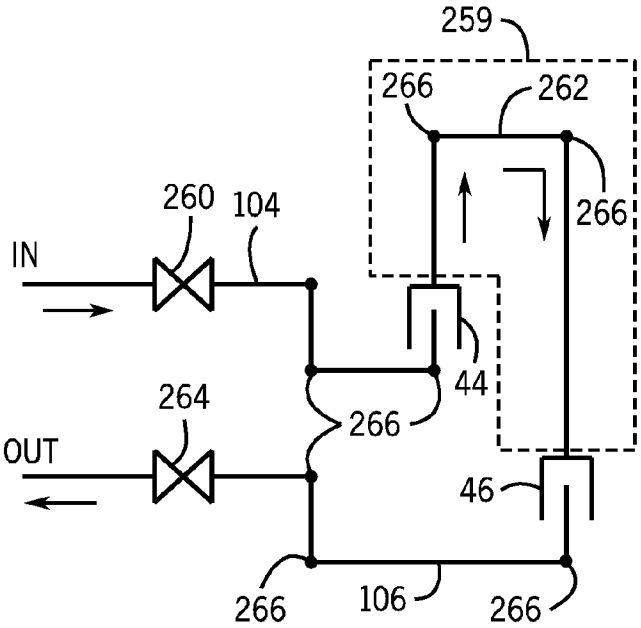

FIGS. 37 and 38 illustrate more clearly how the horizontal deployment configuration of the various the RFM unit embodiments described above (e.g., 26, 140, 150, 170) may exhibit reduction in erosion prone areas and more compact form factors due at least in part to a reduced number pipe bends when compared to subsea equipment having a vertical deployment configuration. As shown in FIG. 37, one or more subsea devices, referred to by reference number 259, has a vertical deployment configuration enabling the device 259 to vertically mate with another subsea device, such as a production tree. The tree may have a wing valve line 104 that includes wing valve 260. The subsea device 259, which may include flow monitoring and control elements like those located in the above-described RFM unit 26, may include an inlet 44 configured to vertically mate with the wing valve line 104. However, it should be noted that the subsea device 259 may not necessarily collocate all such elements in a single standalone and easily retrievable assembly like the RFM unit 26. That is, the subsea device 259 may represent various elements at different locations of a tree.

The vertical mating of the inlet 44 fluidly couples the wing valve line 104 to the flow path 262 through the subsea device 259 Likewise, the tree 24 may include a flow line 106 having valve 264. The subsea device 259 also has the outlet 46 that vertically mates with the flow line 106. As can be seen, due to this vertically-oriented deployment configuration, bends 266 are present on the wing valve line 104 and the flow line 106, as well as within the flow path 262. In this example, a total of eight bends 266 are present in the piping making up the illustrated portions of the wing valve line 104, the flow path 262, and the flow line 106. As discussed above, the presence of such bends may increase erosion prone areas on subsea equipment.

To contrast with the vertical deployment configuration shown in FIG. 37, FIG. 38 illustrates how the RFM unit 26 having a horizontal deployment configuration provides for a horizontal mating of the RFM unit 26 to a tree 24 or other subsea device with a reduced number of pipe bends 266. For instance, in the simplified example of FIG. 38, the illustrated portion of the wing valve line 104, flow path 262, and the flow line 106 has only two pipe bends 266 in the flow path 262. Thus, when compared to the number of pipe bends present on the vertical deployment configuration shown in FIG. 37, the horizontal deployment configuration of the various RFM unit embodiments (e.g., 26, 140, 150, 170) disclosed herein offers a reduction in the number of pipe bends, which may not only allow for a reduction in the overall size of the RFM unit 26 and/or tree 24, but may also reduce erosion prone areas on the piping and thus increase the durability and operational life of the piping and other elements on the RFM unit 26 and the tree 24.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

an inlet, an outlet, and a flow path extending between the inlet and the outlet;

a flow meter configured to determine a flow rate of a fluid through the flow path;

a choke configured to vary the flow rate of the fluid through the flow path;

a frame having an alignment system having a horizontal deployment configuration, wherein the alignment system is configured to facilitate alignment of the apparatus with a separate subsea device to enable the apparatus to horizontally mate with the separate subsea device during a mating process, the alignment system comprises at least one sliding member configured to permit movement of the apparatus when aligning the apparatus with the separate subsea device during the mating process, the sliding member comprises an alignment member configured to engage a corresponding alignment slot on the separate subsea device, and the frame comprises a recess configured to receive a removable running tool; and the removable running tool, wherein the removable running tool comprises a hydraulic cylinder, a first flange configured to be received by a receiving block disposed in the recess, a piston rod extending from the first flange, and a second flange disposed at the distal end of the piston rod and being configured to be received by another receiving block located on the separate subsea device, and wherein the retraction of the piston rod into the hydraulic cylinder of the running tool facilitates movement of the apparatus towards the separate subsea device during the mating process;

wherein the flow path, flow meter, and choke are generally disposed within a region enclosed by the frame, and wherein the frame enables the apparatus to be deployed to or retrieved from a subsea location in a single operation.

2. The apparatus of claim 1, wherein the flow meter is arranged upstream from the choke relative to the direction of fluid flow along the flow path, or is arranged downstream from the choke relative to the direction of fluid flow along the flow path.

3. The apparatus of claim 1, wherein the flow meter comprises at least one of a wet gas flow meter or a multiphase flow meter configured to measure a flow rate of each of a plurality of phases of the fluid.

4. The apparatus of claim 1, wherein the apparatus comprises:

one or more sensing elements;

a subsea monitoring module comprising a controller configured to receive and process data from the one or more sensing elements; and a communication port configured to receive a cable that electronically couples the subsea monitoring module to a separate subsea control module.

5. The apparatus of claim 4, wherein the one or more sensing elements comprises at least one of an acoustic sand detection sensor, a choke position indicator, a sand erosion/corrosion monitor, or a pressure and temperature transducer.

6. The apparatus of claim 4, wherein the subsea monitoring module is configured to transmit processed data to the subsea control module for transmission to a surface communication device.

7. The apparatus of claim 4, wherein the subsea monitoring module is configured to receive data from one or more sensing elements and from the subsea control module, and wherein the subsea monitoring module comprises networking circuitry configured to transmit the received data to a surface communication device.

8. The apparatus of claim 4, wherein the subsea monitoring module comprises a plurality of controllers configured in a redundant manner.

9. The apparatus of claim 1, wherein the inlet and the outlet are both located on a common face of the apparatus.

10. The apparatus of claim 1, wherein the at least one sliding member is configured to slide along a first rod extending across the frame on a bottom face of the apparatus.

11. The apparatus of claim 1, wherein the at least one sliding member comprises:

a first sliding member configured to slide along a first rod extending across the frame on a first side face of the apparatus; and a second sliding member configured to slide along a second rod extending across the frame on a second side face of the apparatus opposite the first side face.

12. The apparatus of claim 1, wherein the frame comprises a first set of alignment slots configured to receive a first set of guide pins extending from the separate subsea device.

13. The apparatus of claim 12, wherein the frame comprises a second set of alignment slots configured to receive a second set of guide pins extending from the separate subsea device, wherein the second set of alignment slots and the first set of alignment slots have different dimensions.

14. The apparatus of claim 1, wherein the separate subsea device comprises at least one of a production tree, a manifold, or a subsea processing station.

15. A method for mating a retrievable flow module (RFM) unit to a subsea tree comprising:

lowering the RFM unit onto a platform of the subsea tree, wherein the RFM unit comprises an inlet, an outlet, and a plurality of flow control and monitoring devices collocated within a frame, the plurality of flow control and monitoring devices comprising a flow meter and a choke;

moving the RFM unit horizontally toward the subsea tree, wherein moving the RFM unit horizontally includes actuating a running tool removably installed on the RFM unit to cause a piston rod having a flange engaged by a receiving block on the subsea tree to retract into a hydraulic cylinder of the running tool; and securing the inlet and the outlet to respective lines of the subsea tree.

16. The method of claim 15, comprising removing the running tool after the RFM unit is mated to the subsea tree.

17. The method of claim 15, wherein moving the RFM unit horizontally toward the subsea tree includes moving the RFM unit horizontally toward the subsea tree until a first set of guide pins extending from the subsea tree is substantially inserted into a first set of alignment slots on the RFM unit.

* * * * *